US007065979B2

(12) United States Patent
Arshansky et al.

(10) Patent No.: US 7,065,979 B2
(45) Date of Patent: Jun. 27, 2006

(54) REFRIGERATION SYSTEM

(75) Inventors: Yakov Arshansky, Conyers, GA (US); David K. Hinde, Rex, GA (US); Richard N. Walker, Monroe, GA (US); Georgi S. Kazachki, Raleigh, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 296 days.

(21) Appl. No.: 10/696,119

(22) Filed: Oct. 29, 2003

(65) Prior Publication Data

US 2004/0148956 A1 Aug. 5, 2004

Related U.S. Application Data

(60) Provisional application No. 60/422,435, filed on Oct. 30, 2002.

(51) Int. Cl.
*F25B 7/00* (2006.01)

(52) U.S. Cl. ..... 62/335; 62/434

(58) Field of Classification Search ..... 62/79, 62/335, 434, 435

See application file for complete search history.

(56) References Cited

U.S. PATENT DOCUMENTS

| | | | | | |
|---|---|---|---|---|---|
| 2,797,068 | A | * | 6/1957 | McFarlan | 165/207 |
| 4,014,182 | A | | 3/1977 | Granryd | |
| 4,429,547 | A | | 2/1984 | Granryd | |
| 4,484,449 | A | * | 11/1984 | Muench | 62/79 |
| 4,984,435 | A | | 1/1991 | Seino et al. | |
| RE33,620 | E | | 6/1991 | Persem | |
| 5,042,262 | A | | 8/1991 | Gyger et al. | |
| 5,046,320 | A | | 9/1991 | Loose et al. | |
| 5,217,064 | A | | 6/1993 | Kellow et al. | |
| 5,335,508 | A | | 8/1994 | Tippmann | |
| 5,351,498 | A | | 10/1994 | Takahashi et al. | |
| 5,386,709 | A | * | 2/1995 | Aaron | 62/199 |
| 5,596,878 | A | | 1/1997 | Hanson et al. | |
| 5,743,110 | A | * | 4/1998 | Laude-Bousquet | 62/434 |
| 6,067,814 | A | | 5/2000 | Imeland | |
| 6,112,532 | A | | 9/2000 | Bakken | |
| 6,148,634 | A | * | 11/2000 | Sherwood | 62/434 |
| RE37,054 | E | | 2/2001 | Sherwood | |
| 6,202,425 | B1 | | 3/2001 | Arshansky et al. | |
| 6,205,795 | B1 | | 3/2001 | Backman et al. | |
| 6,212,898 | B1 | * | 4/2001 | Ueno et al. | 62/335 |
| 6,385,980 | B1 | | 5/2002 | Sienel | |
| 6,393,858 | B1 | * | 5/2002 | Mezaki et al. | 62/335 |
| 6,405,558 | B1 | | 6/2002 | Sheehan | |
| 6,418,735 | B1 | | 7/2002 | Sienel | |

(Continued)

FOREIGN PATENT DOCUMENTS

| | | |
|---|---|---|
| EP | 0 602 911 A1 | 6/1994 |
| EP | 0 675 331 A2 | 10/1995 |
| EP | 1 134 514 A1 | 9/2001 |
| EP | 1 139 041 A2 | 10/2001 |

OTHER PUBLICATIONS

International Search Report for Application No. PCT/US 03/34606, 2 pages.

*Primary Examiner*—William E. Tapolcai
(74) *Attorney, Agent, or Firm*—Foley & Lardner LLP

(57) ABSTRACT

A refrigeration system includes a first cooling system having a refrigerant in thermal communication with a heat exchanger device to provide a first cooling source. A second cooling system has a coolant in thermal communication with the heat exchanger device and a refrigeration device is configured to receive the coolant. A third cooling system is configured to provide a second cooling source to the coolant when the first cooling source is unavailable, so that a pressure of the coolant does not exceed a predetermined level when the first cooling source is unavailable.

58 Claims, 16 Drawing Sheets

U.S. PATENT DOCUMENTS 6,467,279 B1 10/2002 Backman et al.
6,494,054 B1 * 12/2002 Wong et al. ..... 62/335
6,502,412 B1 1/2003 Dubé
6,631,621 B1 10/2003 VanderWoude et al.
6,658,867 B1 12/2003 Taras et al.
6,672,087 B1 1/2004 Taras et al.
2001/0023594 A1 9/2001 Ives
2001/0027663 A1 10/2001 Zeigler et al.
2002/0066286 A1 6/2002 Alsenz
2003/0019219 A1 1/2003 Viegas et al.
2003/0029179 A1 2/2003 VanderWoude et al.

* cited by examiner

FIGURE 6
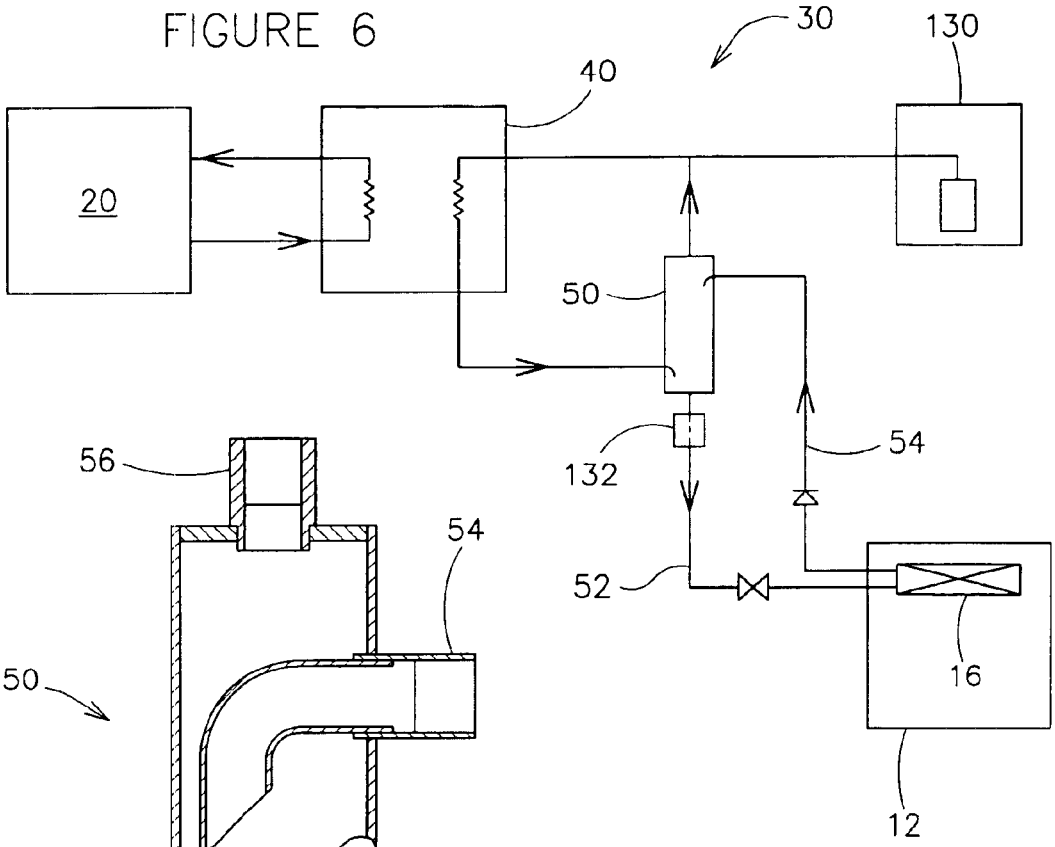
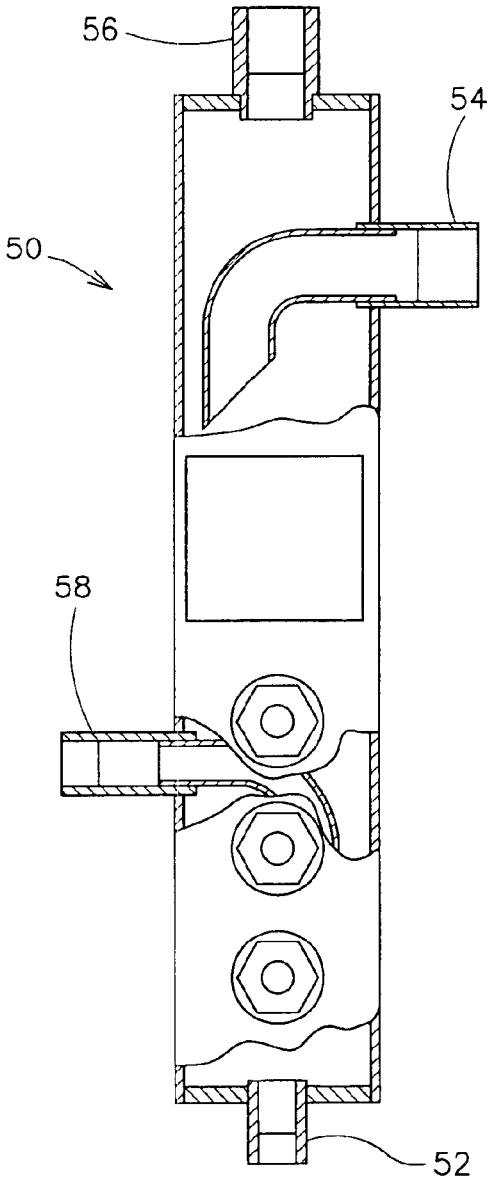
FIGURE 7

REFRIGERATION SYSTEM

CROSS REFERENCE TO RELATED APPLICATIONS

The present patent application claims the benefit of priority as available under 35 U.S.C. § 119(e)(1) to U.S. Provisional Patent Application No. 60/422,435 titled "Refrigeration System" filed on Oct. 30, 2002.

The present patent application incorporates by reference in its entirety U.S. Provisional Patent Application No. 60/422,435 titled "Refrigeration System" filed on Oct. 30, 2002.

FIELD

The present inventions relate to a refrigeration system. The present inventions relate more particularly to a refrigeration system having a secondary coolant. The present inventions relate more particularly to a refrigeration system having carbon dioxide as a secondary coolant.

BACKGROUND

It is well known to provide a refrigeration system such as a refrigerator, freezer, temperature controlled case, etc. that may be used in commercial, institutional, and residential applications for storing or displaying refrigerated or frozen objects. For example, it is known to provide a variety of refrigerated cases for display and storage of frozen or refrigerated foods in a facility such as a supermarket or grocery store to maintain the foods at a suitable temperature well below the room or ambient air temperature within the store. It is also known to provide refrigerated spaces or enclosures, such as walk-in freezers or coolers for maintaining large quantities or stocks of perishable goods at a desired temperature.

Accordingly, it would be advantageous to provide a refrigeration system for use with a variety of refrigeration devices that are located throughout a facility. It would also be desirable to provide a refrigeration system for use with a refrigeration device within a refrigerated enclosure such as a walk-in freezer. It would be further advantageous to provide a refrigeration system that may be operated using a coolant a compound that is naturally found in the atmosphere (instead of or in combination with conventional or synthetic refrigerants). It would be further advantageous to provide a refrigeration system that reduces the amount of conventional refrigerant used. It would be further advantageous to provide a refrigeration system that uses a primary refrigeration system having a primary refrigerant to remove heat from a secondary cooling system having a coolant that is routed to the refrigeration devices. It would be further advantageous to provide a refrigeration system with a secondary cooling system that uses the latent heat of vaporization of the coolant to provide cooling to a refrigeration device. It would be further advantageous to provide a refrigeration system that is configured to use carbon dioxide as a coolant. It would be further advantageous to provide a refrigeration system that combines two or more components of the system into an assembly.

Accordingly, it would be advantageous to provide a refrigeration system having any one or more of these or other advantageous features.

SUMMARY

The present invention relates to a refrigeration system that includes a first cooling system having a refrigerant in thermal communication with a heat exchanger device to provide a first cooling source. A second cooling system has a coolant in thermal communication with the heat exchanger device and a refrigeration device is configured to receive the coolant. A third cooling system is configured to provide a second cooling source to the coolant when the first cooling source is unavailable, so that a pressure of the coolant does not exceed a predetermined level when the first cooling source is unavailable.

The present invention also relates to a refrigeration system that includes a primary cooling system configured to circulate a refrigerant to a heat exchanger. A secondary cooling system is configured to circulate a coolant to the heat exchanger and at least one refrigeration device. A separator is configured to direct a vapor portion of the coolant to the heat exchanger and a liquid portion of the coolant to the refrigeration device. A third cooling system is configured to receive a vapor portion of the coolant from the secondary cooling system.

The present invention also relates to a refrigeration system that includes a primary cooling system configured to provide a first source of cooling to a coolant. A standby cooling system is configured to provide a second source of cooling to the coolant. A secondary cooling system is configured to circulate the coolant to at least one refrigeration device and to be cooled by the first source of cooling when the first source of cooling is operational, and to be cooled by the second source of cooling when the first source of cooling is not operational, so that a temperature of the coolant does not exceed a predetermined temperature.

The present invention also relates to a method of providing cooling to at least one cooling device and includes circulating a refrigerant to a heat exchanger, circulating a coolant to the heat exchanger, routing the coolant to a separator, directing a vapor portion of the coolant to the heat exchanger, directing a liquid portion of the coolant to the cooling device, and directing the coolant from the cooling device to the separator.

The present invention also relates to a refrigeration system and includes a primary cooling system configured to provide a cooling source. A secondary cooling system is configured to route a coolant to be cooled by the cooling source, and a vessel communicating with the secondary cooling system is configured to accommodate an increase in temperature of the coolant when the cooling source is insufficient to maintain the coolant below a predetermined temperature.

The present invention also relates to a refrigeration system and includes a primary cooling system configured to provide a source of cooling. A secondary cooling system is configured to circulate a coolant to be cooled by the source of cooling, where the coolant is in one of a liquid state, a vapor state and a liquid-vapor state. A volume is inherent in the secondary cooling system and is configured to accommodate expansion of the coolant in the event that the source of cooling is insufficient to maintain the temperature of the coolant below a predetermined temperature level.

BRIEF DESCRIPTION OF THE DRAWINGS

FIG. 6 is a detailed schematic diagram of the refrigeration system of FIG. 5 according to a preferred embodiment.

FIG. 7 is a side view of a component of the refrigeration system of FIG. 5 according to an exemplary embodiment.

Figure 1:
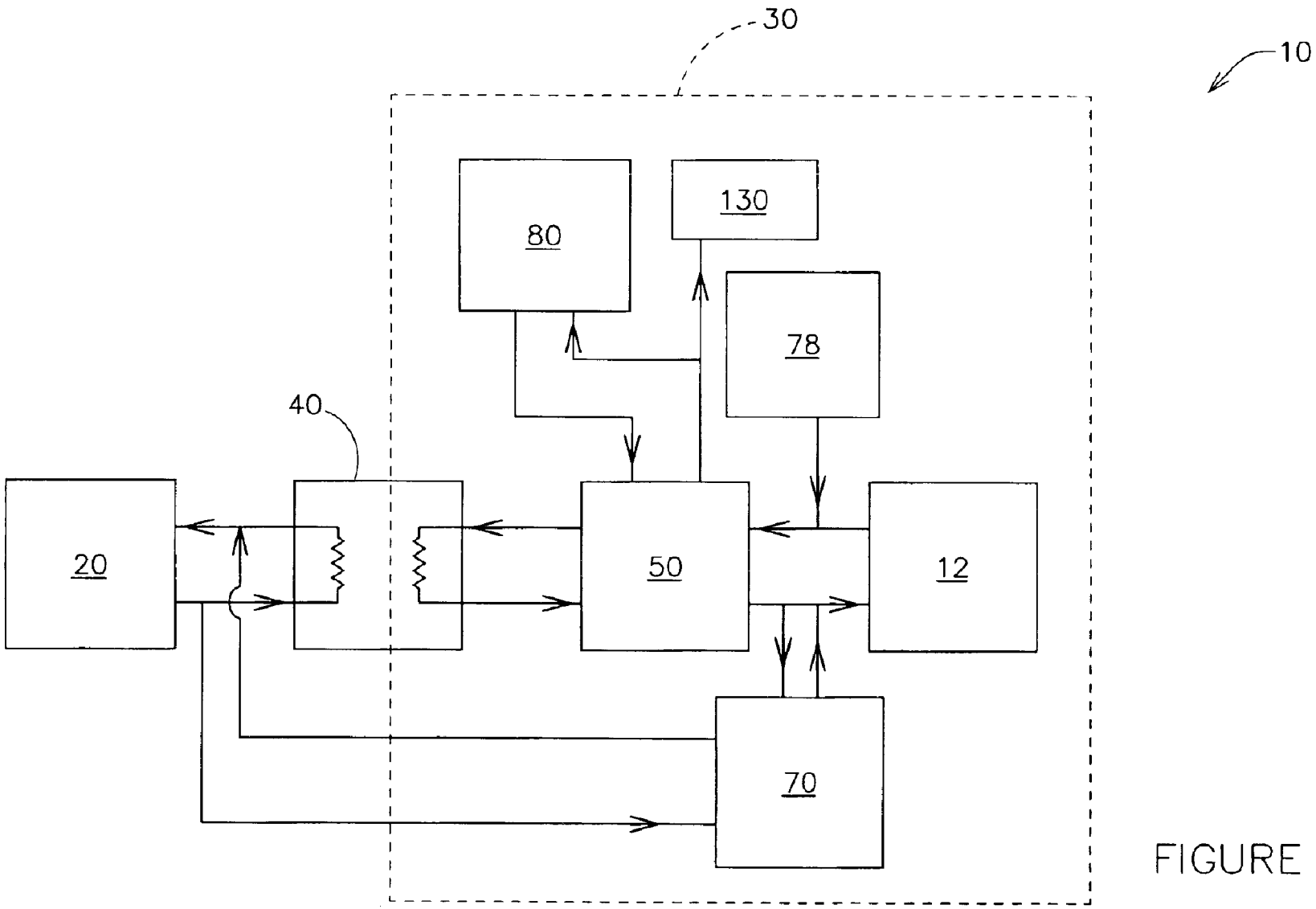
FIG. 1 is a schematic diagram of a refrigeration system according to a preferred embodiment.

TABLE 1 is a listing of design and sizing parameters and considerations for use in developing a refrigeration system according to an exemplary embodiment (6 pages).

TABLE 2 is a is a listing of design and sizing parameters and considerations for use in developing a refrigeration system according to an exemplary embodiment (3 pages).

DETAILED DESCRIPTION

Referring to the FIGURES, a refrigeration system 10 is shown having primary refrigeration system 20 intended to cool a secondary cooling system 30 that has a coolant configured for circulation to one or more refrigeration devices 12. The refrigeration system is intended to reduce the amount of conventional refrigerant used to provide cooling to the refrigeration devices by providing a secondary cooling loop that uses as a coolant a compound that is found naturally in the atmosphere. In typical refrigeration systems that use a conventional refrigerant, such refrigeration systems often include conventional components that are configured to accommodate the pressure level associated with the saturation pressure of the refrigerant within the volume of the refrigeration system in the event that the refrigerant reaches the temperature of the surrounding ambient environment. Compounds that are found in atmospheric air, when used as a coolant in a quantity necessary to provide the desired cooling to the refrigeration devices and with the typical volume of a conventional refrigeration system, may be associated with a saturation pressure that exceeds the maximum design pressure of conventional refrigeration components if the temperature of the coolant increases substantially above a normal operating temperature (e.g. when the coolant approaches the ambient temperature of the surrounding environment). According to any preferred embodiment, the refrigeration system maintains the coolant within a desired pressure range for use with conventional or other refrigeration system components.

Referring to FIG. 1, a refrigeration system 10 having a primary refrigeration system 20 and a secondary cooling system 30 is shown according to one preferred embodiment. Secondary cooling system 30 is shown schematically as interfacing with a main condenser-evaporator 40, and including a separator 50, a subcooler device 70, at least one refrigeration device 12, and a standby condensing system 80.

Figure 2A:
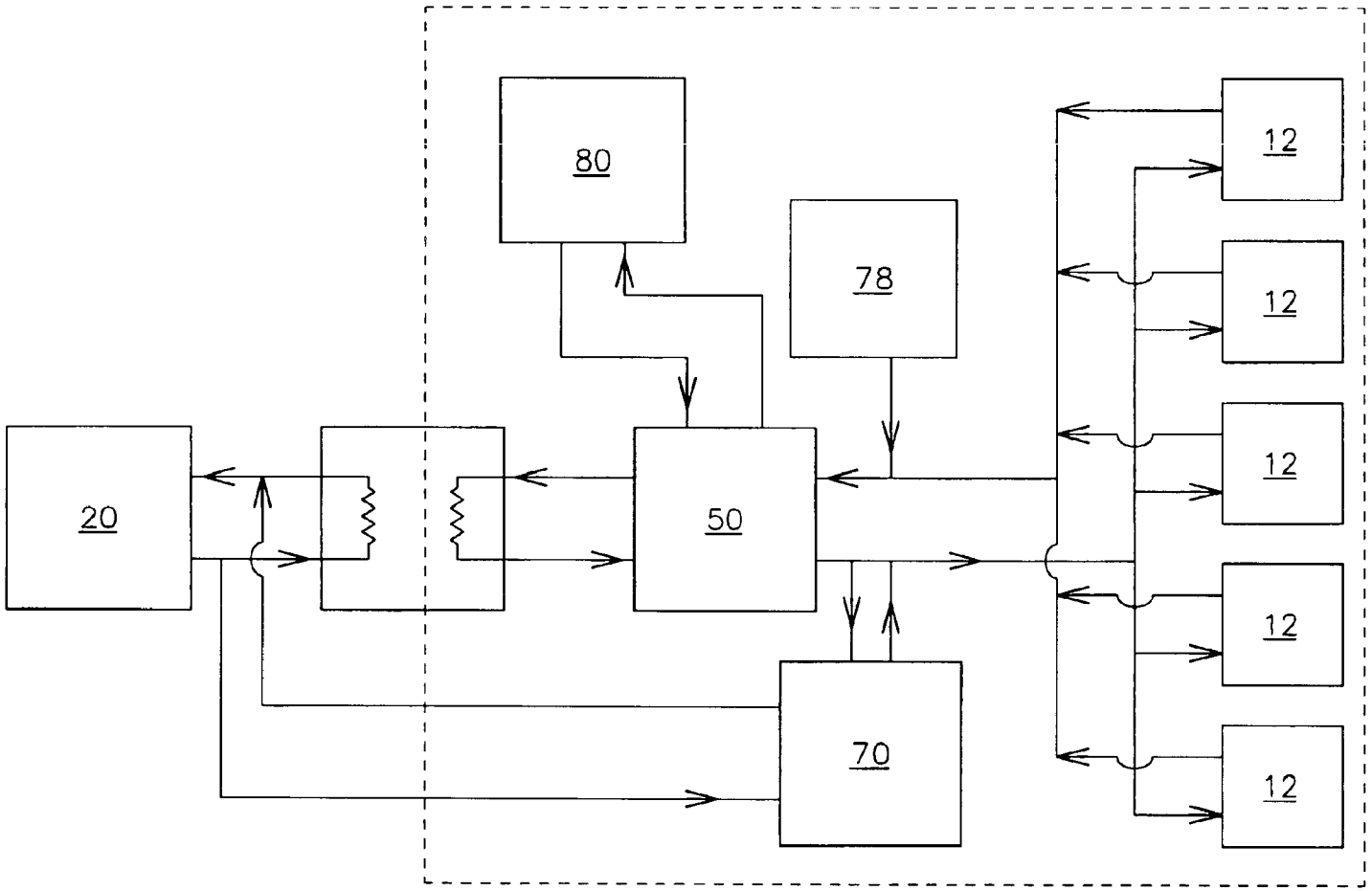
FIG. 2A is a schematic diagram of a refrigeration system according to a preferred embodiment.
Figure 2B:
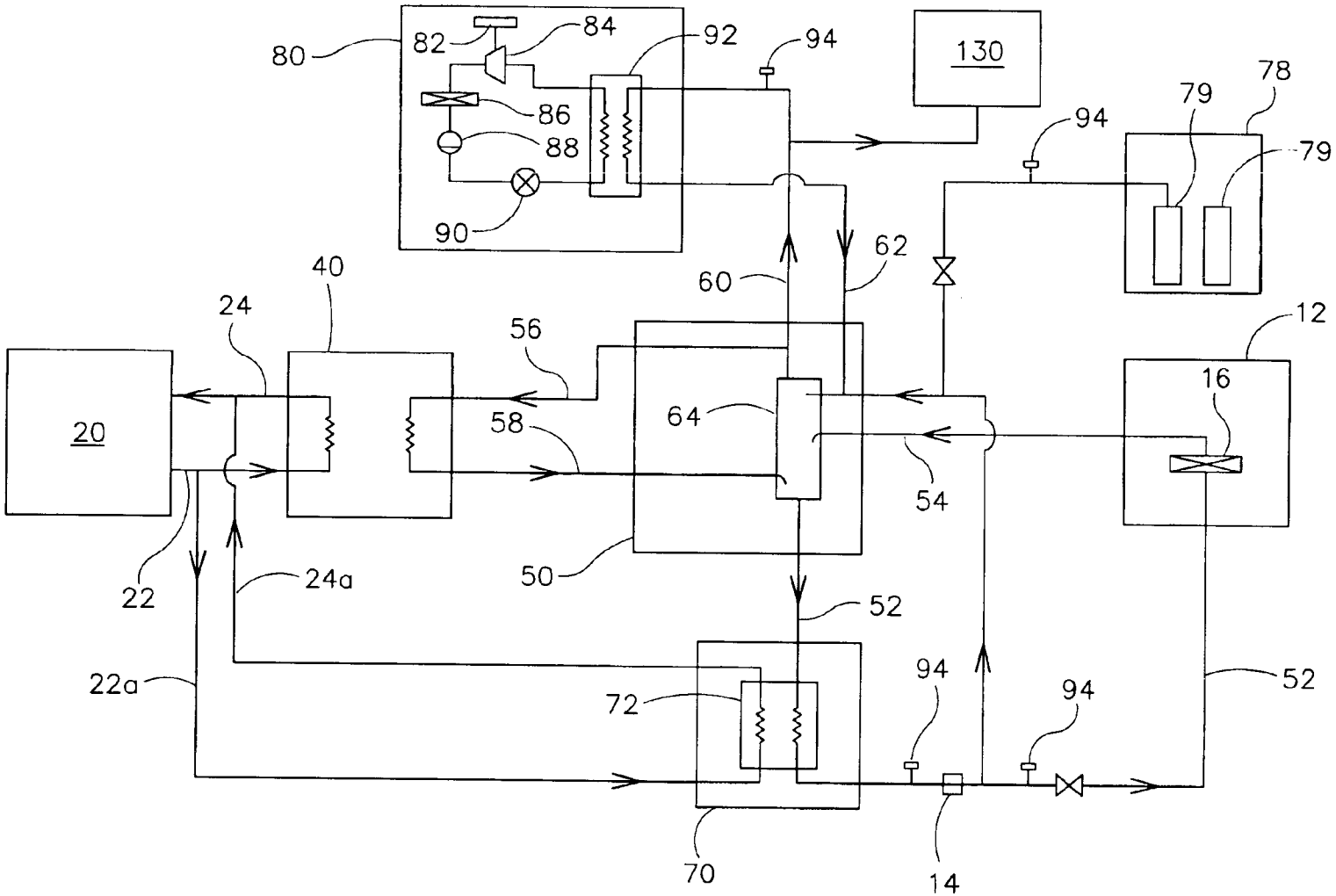
FIG. 2B is a detailed schematic diagram of the refrigeration system of FIG. 1 according to a preferred embodiment.
Figure 2C:
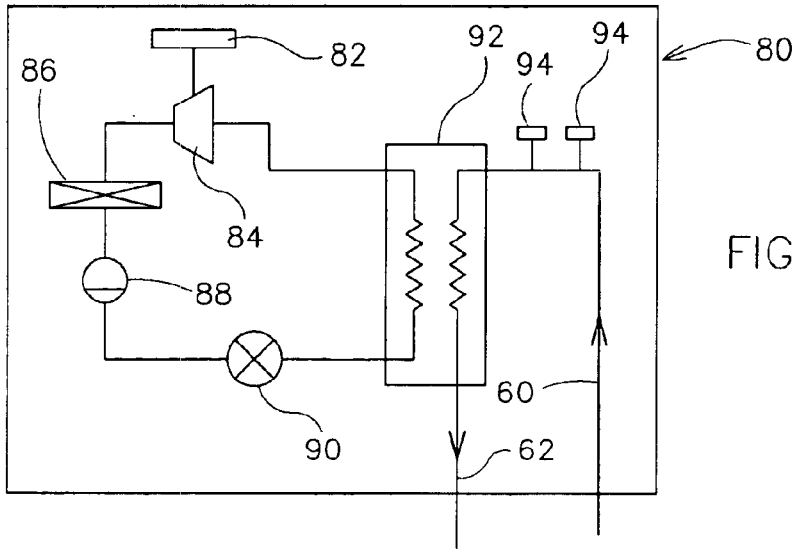
FIG. 2C is a schematic diagram of a portion of the refrigeration system of FIG. 1 according to a preferred embodiment.
Figure 2D:
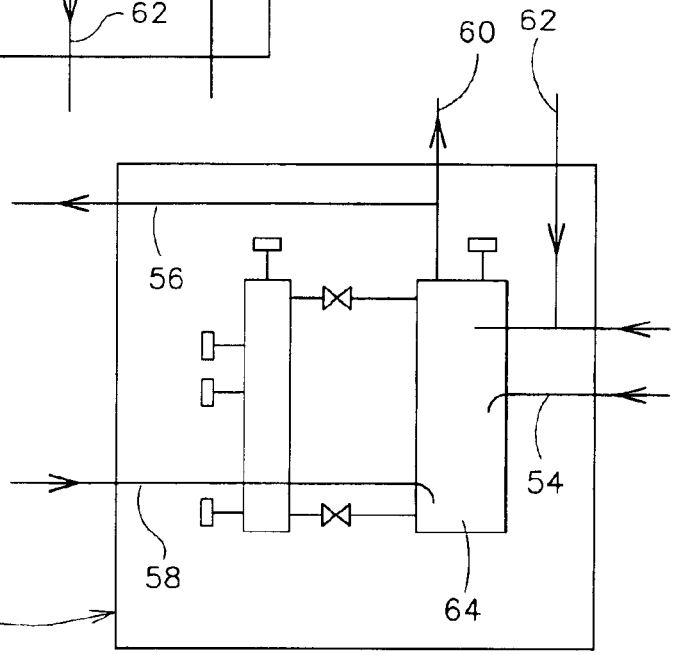
FIG. 2D is a schematic diagram of a portion of the refrigeration system of FIG. 1 according to a preferred embodiment.
Figure 2E:
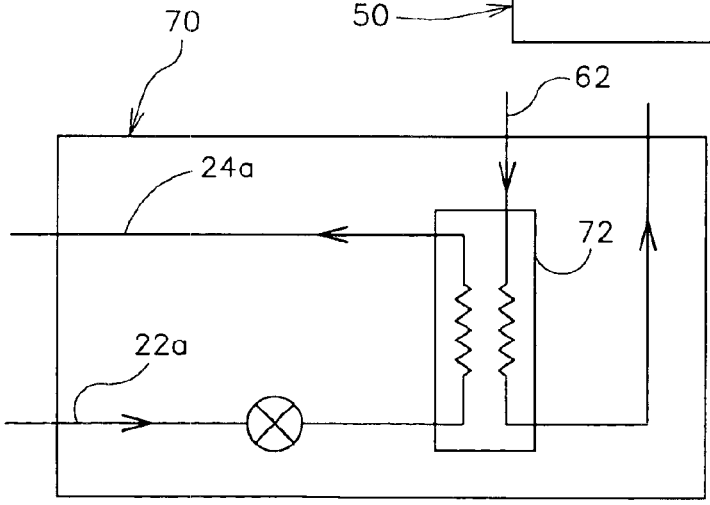
FIG. 2E is a schematic diagram of a portion of the refrigeration system of FIG. 1 according to a preferred embodiment.
Figure 3A:
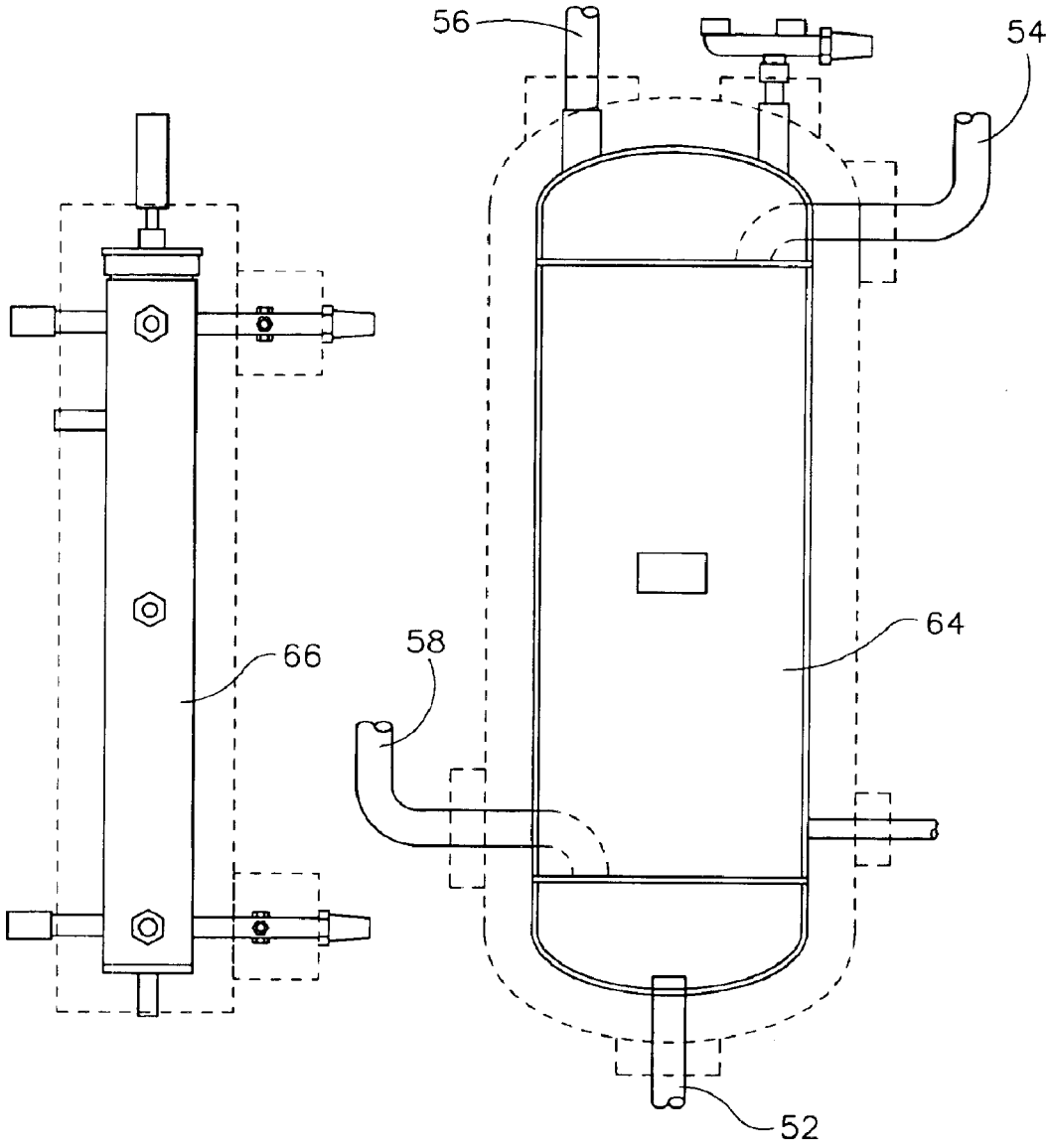
FIG. 3A is a front view of a portion of the refrigeration system of FIG. 1 according to an exemplary embodiment.
Figure 3C:
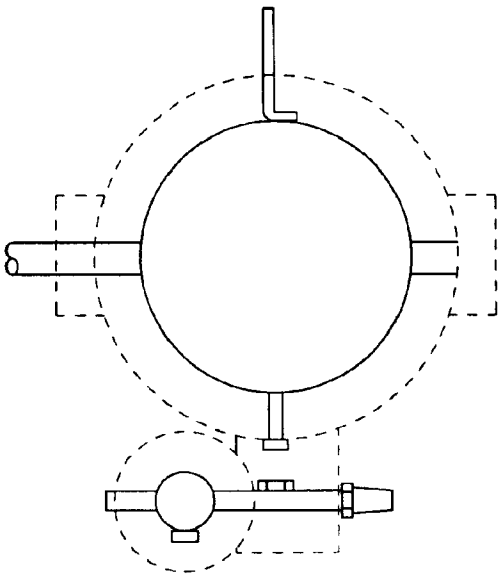
FIG. 3C is a top view of a portion of the refrigeration system of FIG. 1 according to an exemplary embodiment.
Figure 3B:
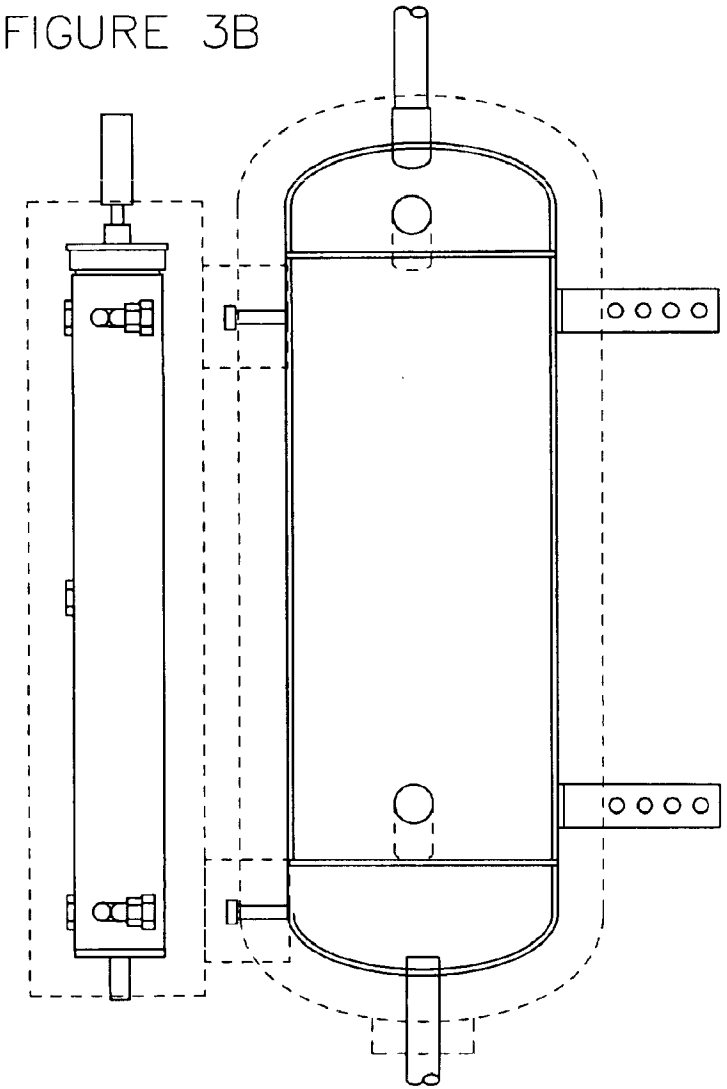
FIG. 3B is a side view of a portion of the refrigeration system of FIG. 1 according to an exemplary embodiment.

Referring to FIGS. 1 through 2B, primary refrigeration system 20 includes refrigeration equipment of a conventional type (e.g. compressor, condenser, receiver, expansion device, valves, tubing, fittings, etc.—not shown) that are configured to a cool and route a primary refrigerant to a heat exchanger (shown schematically as main condenser-evaporator device 40 and may be a plate-type or other suitable type of heat exchanger). According to a particularly preferred embodiment, primary refrigeration system 20 is a direct expansion system and the primary refrigerant (such as a conventional refrigerant, for example, R-507 or ammonia) has a temperature at the inlet to main condenser-evaporator 40 of approximately −25 deg F. [below zero] (or lower as required by the particular application). All or a portion of the primary refrigeration system 20 may be provided at any suitable location such as on the roof of a facility (e.g. supermarket, grocery store, etc.) or in an equipment room within the facility or other suitable location. Primary refrigeration system 20 is operated and controlled in a conventional manner to provide a desired amount of cooling to the main condenser-evaporator, in response to the heat load on the main condenser-evaporator from the secondary cooling system. According to an alternative embodiment, the primary refrigeration system may be a "flooded" type system (i.e. the refrigerant exiting the heat exchanger may contain both liquid and vapor and may be moved through the system primarily by gravity and thermal conditions).

Figure 4A:
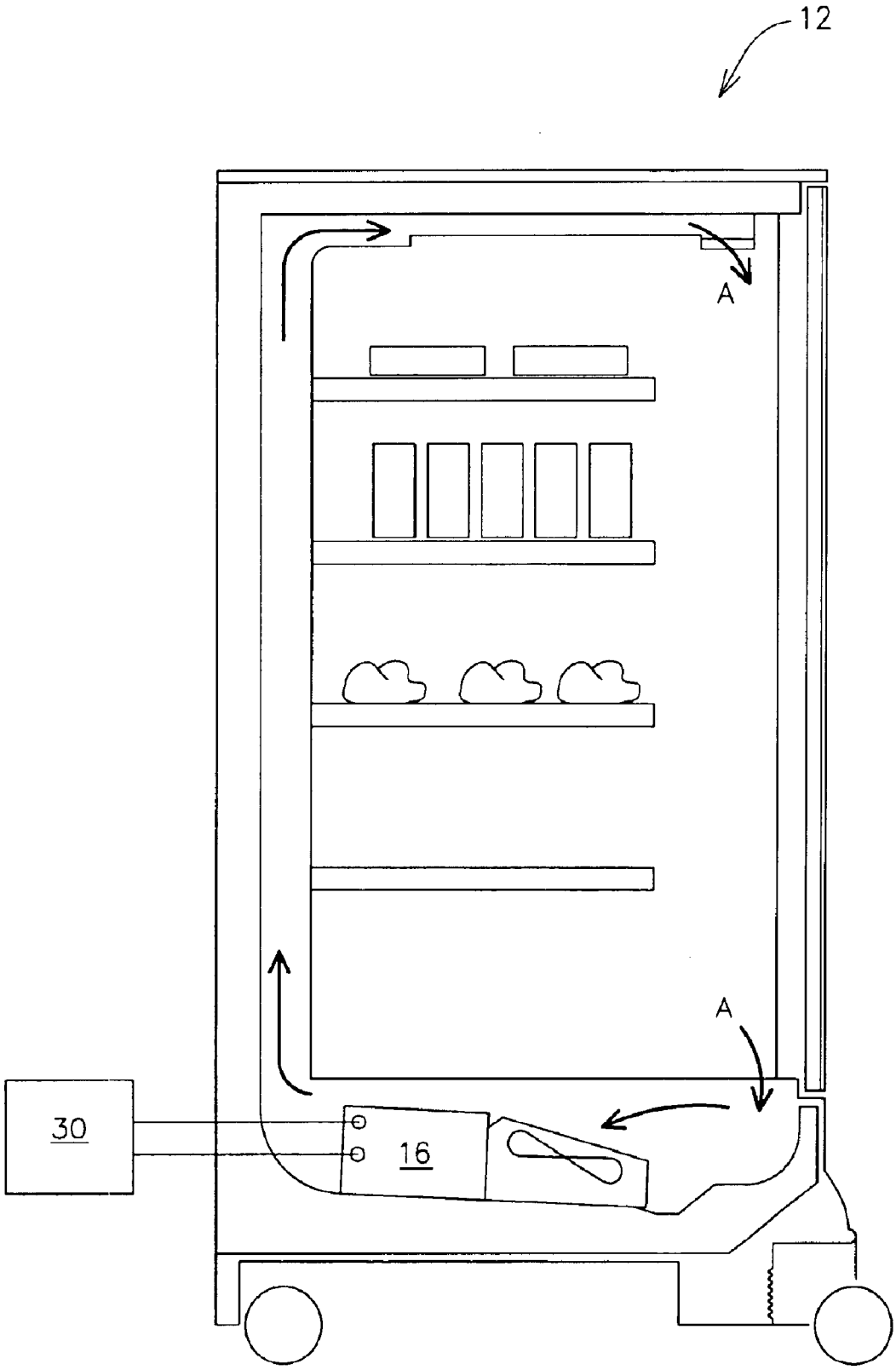
FIG. 4A is a schematic diagram of a refrigeration device according to an exemplary embodiment.
Figure 4B:
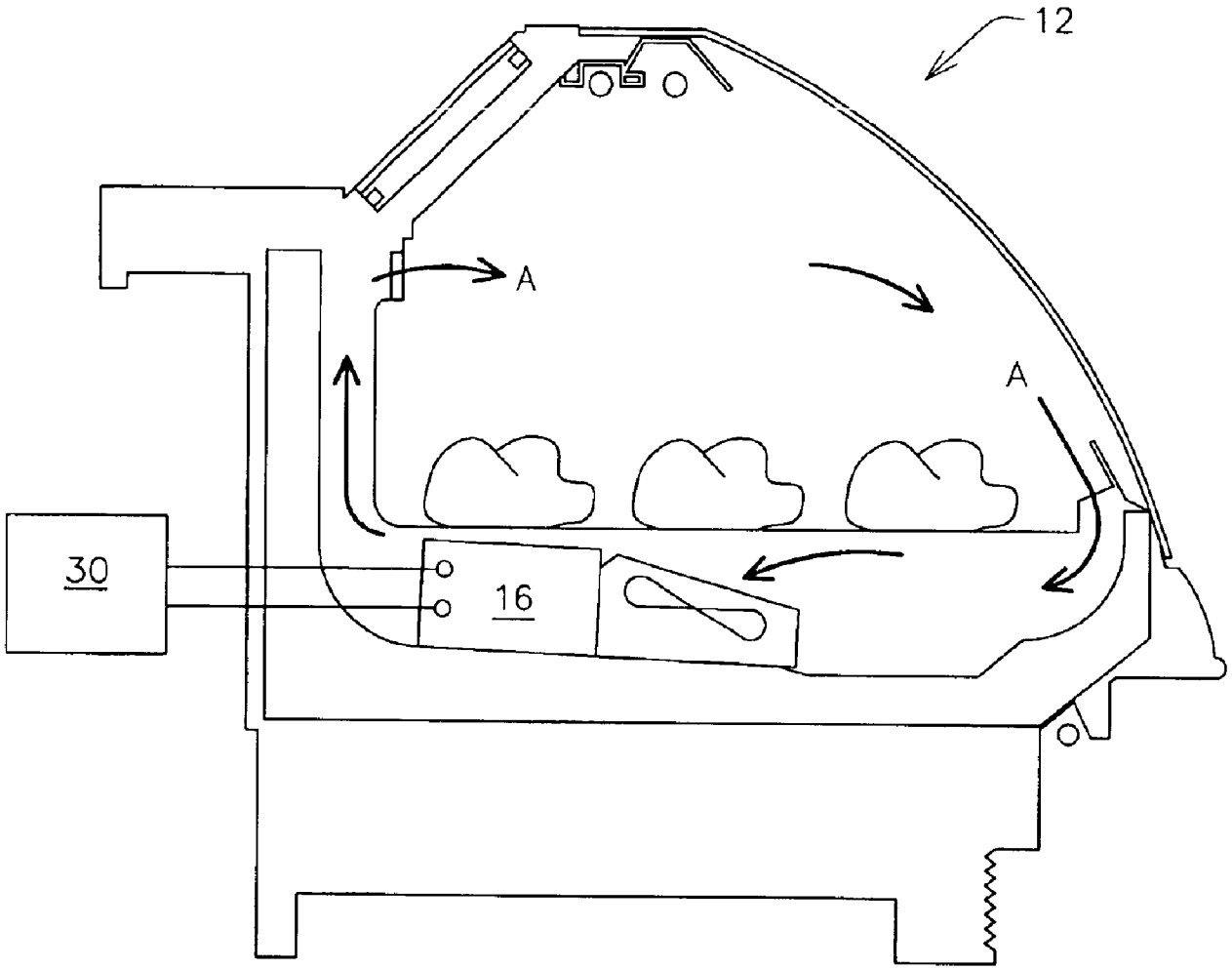
FIG. 4B is a schematic diagram of a refrigeration device according to an exemplary embodiment.
Figure 4C:
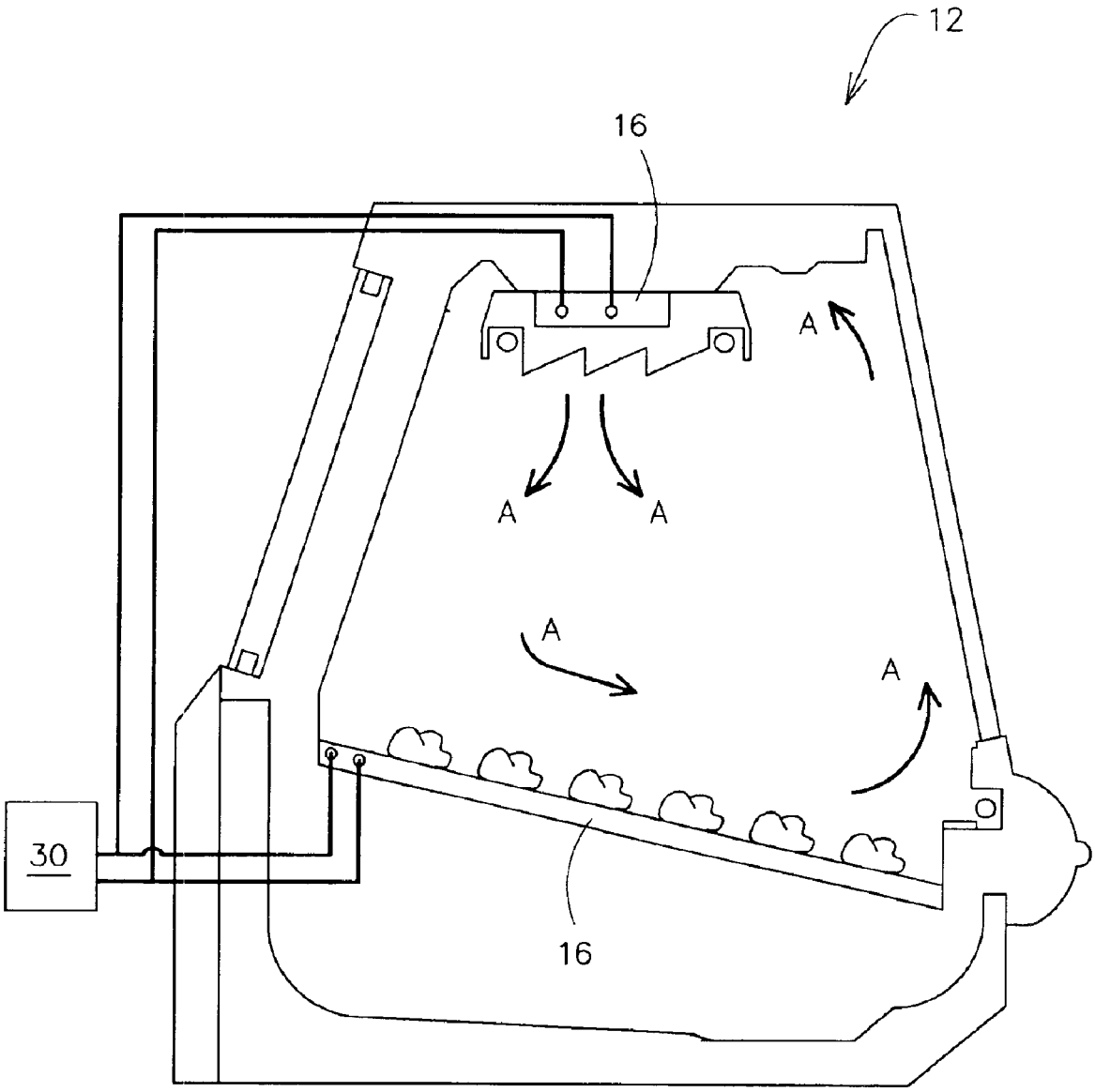
FIG. 4C is a schematic diagram of a refrigeration device according to an exemplary embodiment.

Referring further to FIGS. 1 through 2B, secondary cooling system 30 includes a coolant adapted to circulate to main condenser-evaporator 40, separator 50 (shown schematically as a liquid-vapor separator device in a generally vertical orientation—see FIGS. 2D and 3A through 3C), a subcooler device 70 (see FIG. 2E), at least one refrigeration device 12 (such as shown schematically, for example, in FIGS. 4A through 4C), and a standby condensing system 80 (shown schematically as an auxiliary condensing system). A secondary coolant is configured for routing through secondary cooling system 30. The coolant is circulated to the main condenser-evaporator 40 for cooling and condensation and then directed to separator 50. Coolant in separator 50 that is in a vapor state rises to the top of separator 50 and is directed back to main condenser-evaporator 40 for further cooling and condensation. Coolant in separator 50 that is in a liquid state falls to the bottom of separator 50 and is routed to refrigeration device 12 by natural circulation or by a coolant flow device (e.g. centrifugal pump or positive displacement type pump, etc., shown schematically as pump 14 in FIG. 2B) at a temperature suitable for use in a cooling interface 16 (e.g. evaporator, cooling coil, etc. of a conventional type) to cool objects (e.g. food products, perishable items. etc.) in the refrigeration device. According to an alternative embodiment, the secondary cooling system may be provided without a separator for systems in which the coolant is returned from the refrigeration devices to the main condenser evaporator without separation of a liquid portion from a vapor portion of the coolant.

In the event that carryover of vapor occurs in the supply of coolant to the refrigeration devices (depending on the nature and type of the application), a subcooler 70 having a heat exchanger 72 may be provided that is configured to circulate a refrigerant from the primary refrigeration system 20 via a supply line 22*a* and a return line 24*a* to provide sufficient additional cooling to condense any remaining vapor to provide substantially entirely liquid coolant to any coolant flow devices (e.g. pumps such as a gear pump or centrifugal pump, etc.). In the event that vapor carryover does not occur in the actual system installation, the subcooler may be removed, retired, or omitted. According to a particularly preferred embodiment, refrigeration device 12 is a "low temperature" device (e.g. walk-in freezer, reach-in freezer, coffin-type freezer, etc.) and the temperature of the coolant leaving main condenser-evaporator 40 is approximately −20 deg F. [below zero] (e.g. −15 to −25 deg F. [below zero]). According to an alternative embodiment, the refrigeration devices may be "medium temperature" devices, such as temperature controlled cases for meat, fish, and deli applications.

Secondary cooling system 30 may interface with a single refrigeration device 12 (see FIG. 1) or with multiple refrigeration devices 12 (see FIG. 2A). In systems having multiple refrigeration devices, the flow of coolant to each of the refrigeration devices may be controlled in an "on/off" manner by opening and closing a valve (not shown) based on a signal representative of the cooling demand of the refrigeration device (e.g. temperature of air space, cooling interface, product, thermostat, timer, etc.). The flow of coolant to each of the refrigeration devices may also be regulated proportionately in a manner that increases or decreases flow by regulating the position of a flow control device (e.g. valve, etc.).

The temperature and pressure of the coolant in the secondary cooling system are normally maintained within a desired range by the cooling/condensation provided by the primary refrigeration system in connection with the main condenser-evaporator. The temperature of the coolant may increase if the refrigerant in the primary refrigeration system is unable to provide a necessary amount of cooling (e.g. the primary refrigeration system becomes unavailable, malfunctions, operates at a decreased performance level, power outages, maintenance, breakdown, etc.). When the temperature of the coolant increases, an increase in pressure of the coolant occurs, due to the generally constant volume of the piping and components of the secondary cooling system. The primary refrigeration system may become unavailable under any of a variety of circumstances. For example, the primary refrigeration system may become intentionally undersized or unavailable (e.g. during defrost operation, maintenance or service activities, etc.) or the primary refrigeration system may become unintentionally (or accidentally) unavailable (e.g. due to equipment failure, power loss, refrigerant leakage, etc.). The amount of coolant in the secondary cooling system is based on the heat removal requirements of the refrigeration devices (using standard design considerations, such as ambient temperature and humidity, usage factor, etc.). Due to the heat transferred to the coolant in the cooling interfaces (e.g. evaporators, etc.) of each of the refrigeration devices, some portion of the liquid coolant will evaporate or transition to a vapor state.

According to any preferred embodiment, the latent heat of vaporization is used to remove heat from the refrigeration device (e.g. in a cooling interface such as an evaporator, cooling coil, refrigerated pan, gravity coil, etc.) rather than accomplishing heat removal solely by sensible cooling with a liquid coolant. The system is designed with a circulation rate which is defined as the (dimensionless) ratio of the mass flow of liquid coolant supplied to the refrigeration device divided by the mass flow of liquid that evaporates in the refrigeration device. Thus if the circulation rate is 1.0, all of the liquid coolant being provided to the refrigeration device is evaporated. If the recirculation rate is greater than 1.0 a "liquid overfeed" condition is provided where only a portion of the liquid coolant provided to the refrigeration device is evaporated and a mixture of liquid and vapor coolant is returned from the refrigeration device.

According to a particularly preferred embodiment, secondary cooling system 30 is designed with a circulation rate of approximately 2.0 (i.e. one-half of the liquid supplied to the refrigeration device is evaporated). As the coolant removes heat from refrigeration device 12, the vapor content of the coolant increases and the coolant in vapor form or mixed liquid and vapor form is routed to separator 50. The liquid portion of the coolant returned from refrigeration device 12 falls to the bottom of separator 50 and is directed back to refrigeration device 12 and the vapor portion of the coolant rises to the top of separator 50 and is directed to main condenser-evaporator 40 to complete the cycle.

For refrigeration systems that include a coolant flow device (such as pump 14 shown in FIG. 2B), the pump can be provided with a variable control device to facilitate circulation of the coolant under varying load conditions (e.g. beginning and ending defrost cycles, cooling loads, etc.). Typical refrigeration systems having a pump with a variable speed drive tend to control the speed of the pump based on the pressure difference (e.g. head, etc.) necessary to circulate the coolant between the system supply and return at a relatively constant pressure difference. According to one embodiment, the speed of the pump is variably controlled according to a "superheat" condition of the coolant exiting the refrigeration devices. The circulation of the coolant is maintained at a circulation rate of slightly less than 1.0, where the coolant supplied to the refrigeration devices is evaporated and leaves the refrigeration device(s) at a slightly "superheated" condition (e.g. between 1 and 5 degrees F. above the saturation temperature of the coolant). The speed of the pump is controlled in a manner to maintain the "superheat" temperature of the coolant exiting the refrigeration within a predetermined range (e.g. between 1 and 5 degrees F.) corresponding to a desired circulation rate (e.g. slightly less than 1.0). According to another embodiment, the speed of the pump may be controlled so that the coolant exiting the refrigeration device is at approximately saturated vapor conditions with a circulation rate of approximately 1.0. In such an alternative embodiment, the coolant may gain heat in the return piping (e.g. through insulation, etc.) so that the coolant is in a slightly superheated condition. It is believed that variable speed control of the coolant flow device in such a manner minimizes the energy consumed by the pump, maintains the desired rate of flow of coolant within the system, and may improve the energy efficiency of the refrigeration system.

According to any preferred embodiment, the components of the secondary cooling system are configured to withstand the higher operating pressures that correspond to the warmer temperature of the coolant used in such medium temperature applications. According to another alternative embodiment, the secondary cooling system may use the coolant in a liquid phase only (e.g. without vaporization) for sensible heat transfer.

According to a particularly preferred embodiment, main condenser-evaporator 40 is provided at an elevated location above the components of secondary cooling system 30 (e.g. on a roof, in an overhead area, etc.) to promote a "natural" circulation of the coolant by gravity flow and temperature gradients. For applications involving a single refrigeration device 12, such as a walk-in cooler or other enclosed space, the natural circulation of the coolant may be sufficient to circulate the coolant within the secondary cooling system, and coolant flow devices, such as pumps, etc. may be omitted.

Referring to FIGS. 1 and 2B, secondary cooling system 30 may also include a charging system 78 for providing initial charging of the coolant in secondary cooling system 30, or recharging in the event of leakage or other loss of secondary coolant from secondary cooling system 30. Charging system 78 is shown including a supply source of coolant (e.g. tank, pressurized cylinder, etc.). According to a particularly preferred embodiment, the secondary coolant is carbon dioxide (CO2) as defined by ASHRAE as refrigerant R-744 that is maintained below a predetermined maximum design temperature that corresponds to a pressure that is suitable for use with conventional refrigeration and cooling equipment (e.g. cooling coils and evaporators in the refrigeration device, the condenser-evaporator, valves, instrumentation, piping, etc.).

The use of CO2 within a temperature range that corresponds to a pressure within the limitations of conventional refrigeration equipment is intended to permit the system to be assembled from generally commercially available components (or components which can be readily fabricated) and tends to avoid the expense and time associated with custom designed and manufactured equipment that would otherwise be required for use with CO2 at pressure levels that correspond to normal ambient temperature levels. Primary refrigeration system 20 maintains the coolant at a suitable temperature for use in providing cooling to refrigeration devices 12, and well below the design temperature of the coolant that corresponds to the pressure limitations of the equipment. According to a particularly preferred embodiment, the predetermined normal design temperature is approximately 22 degrees F., corresponding to a pressure of the coolant in the system of approximately 420 pounds per square inch gage (psig). In the event of unavailability of primary refrigeration system 20 (e.g. equipment malfunction, power loss, defrost, maintenance, etc.) the temperature of the coolant may begin to approach ambient temperature (typically well above the normal design temperature) which raises the possibility that the corresponding increase in pressure may actuate over-pressure protection devices (e.g. relief valves, rupture discs, etc.) intended to prevent damage to components of the secondary cooling system. Actuation of the over-pressure protection devices (such as relief valves 94 as shown schematically in FIGS. 2B through 2D) may result in discharge of the coolant to the atmosphere, which typically requires maintenance and recharging of the system. According to an exemplary embodiment, relief valves 94 are configured to return the discharged coolant to another portion of the system (see for example FIG. 15).

Referring further to FIGS. 1 and 2A through 2C, standby condensing system 80 (e.g. backup condensing system, auxiliary condensing system, etc.) is provided in the event that operation of primary refrigeration system 20 is unavailable or otherwise insufficient to maintain the coolant below the design temperature. A control system may be provided to monitor parameters representative of the primary refrigeration system, or the pressure and/or temperature conditions of the coolant in the secondary cooling system to initiate the standby condensing system when required. According to a preferred embodiment, when standby condensing system 80 is initiated (e.g. activated, etc.) the control system terminates operation of pumps that circulate the coolant, and fans that transfer heat to the coolant (e.g. at the cooling interfaces) to minimize the amount of heat added to the coolant. Standby condensing system 80 is sized to provide sufficient heat removal capability to maintain the coolant below the maximum design pressure, but typically not to maintain the coolant at the desired supply temperature to refrigeration devices 12.

Standby condensing system 80 is shown as provided with a back-up power supply 82 (e.g. gas or diesel generator, battery system, etc.) that may be configured to operate upon any suitable demand signal (e.g. loss of electrical power, coolant pressure increase, etc.). Backup power supply 82 is configured to provide sufficient energy to operate the components of standby condensing system 80, shown as a compressor 84, a condenser 86, a receiver 88, an expansion device 90, and a standby condenser-evaporator 92. To further protect the components of secondary cooling system 30 from damage, over-pressure relief devices 94 (e.g. relief valves, etc.) are provided at appropriate locations throughout secondary cooling system 30 and are vented to "safe" locations (e.g. outdoors, an area outside of the walk-in freezer or facility, etc.). Relief devices 94 may be adjustable and set to regulate the CO2 pressure of the system at a predetermined level below the pressure limitations of the system. According to an alternative embodiment, the standby condensing system may comprise a portion of the primary refrigeration system. For example, a standby generator may be configured for connection to the primary refrigeration system to provide power or at least one compressor of the primary refrigeration system in the event that electric power is lost at the facility, etc.). By further way of example, the standby condensing system may have a compressor configured to provide a refrigerant to the main condenser-evaporator. According to any alternative embodiment, the standby condensing system and the primary condensing system may "share" one or more components to reduce the cost, size, and complexity of the system.

According to any exemplary embodiment, the primary refrigeration system and the secondary cooling system are provided with conventional components such as controls, gages, indicators and instruments associated with measurement of parameters such as temperature, pressure, flow, CO2 concentration, humidity and level to provide signals or indications representative of the measured parameter, and may be provided for testing and setup of the refrigeration system, or testing, setup and operation of the refrigeration system.

Referring to FIGS. 2D and 3A through 3C, additional features and details of separator 50 are shown according to an exemplary embodiment. Separator 50 is shown schematically as a separate component from the other components of the refrigeration system and includes a vessel 64 with a supply line 52 and a return line 54 for refrigeration devices 12, a supply line 56 and return line 58 to main condenser-evaporator 40, a supply line 60 and return line 62 to standby condensing system 80 and suitable connections for a level indicating device 66 configured to provide an indication and/or signal(s) representative of the level of liquid coolant in vessel 64 of separator 50.

Referring to FIGS. 1 through 3C, the components of the refrigeration system 10 are shown as separate components that are interconnected by suitable connections (e.g. tubing, piping, connectors, fittings, unions, valves, etc.). According to other exemplary embodiments, the components of the refrigeration system may be designed with one or more of the components combined into a combination-type or integrated-type device or assembly. The ability to combine the components of the refrigeration system into one or more combinations or assemblies is intended to reduce the size, cost and complexity of the refrigeration system, and to improve system performance and ease of installation.

Figure 8:
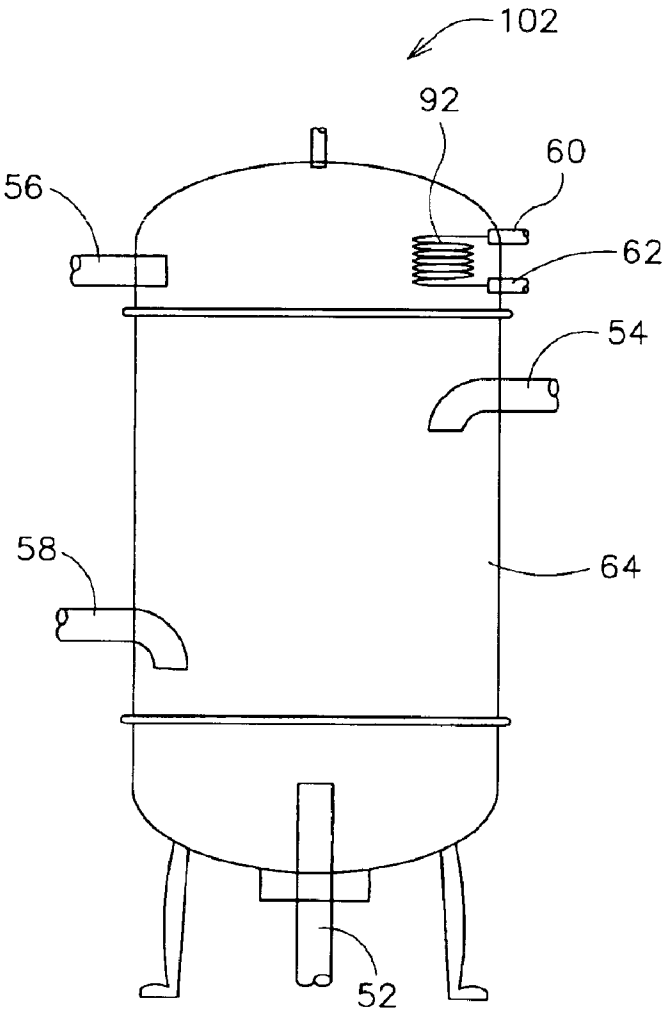
FIG. 8 is a side view of a schematic representation of components of the refrigeration system according to an exemplary embodiment.

Referring to FIG. 8, one configuration of an assembly 102 combining the separator and the standby condenser-evaporator is shown according to an exemplary embodiment. Assembly 102 is shown schematically comprising vessel 64 having connections for supply line 52 and return line 54 to refrigeration device(s) 12, connections for supply line 56 and return line 58 from main condenser-evaporator 40, and supply line 60 and return line 62 from standby condensing system 80. Standby condenser-evaporator 92 is shown schematically as a heat exchanger (e.g. tube coil, etc.) provided generally within the uppermost portion of vessel 64 having a heat transfer surface and configured to provide a source of cooling within separator 50 by circulating a flow of a refrigerant from standby condensing system 80. The positioning of standby condenser-evaporator 92 within the uppermost portion of vessel 64 is intended to enhance condensation of secondary coolant from a vapor state to a liquid state on the heat transfer surface. The condensed liquid coolant drains to a lower portion of vessel 64. Vessel 64 may have any suitable size and shape. According to one embodiment, the vessel is generally cylindrical with a height of approximately 32 inches and a diameter of approximately 16 inches, however, other suitable shapes and sizes may be used. According to an alternative embodiment, the standby condenser-evaporator may have any suitable shape and form (such as finned surfaces, etc.) and may be located at any suitable position in relation to the vessel for cooling and condensing vapor within the separator when the standby condensing system is activated.

Figure 9:
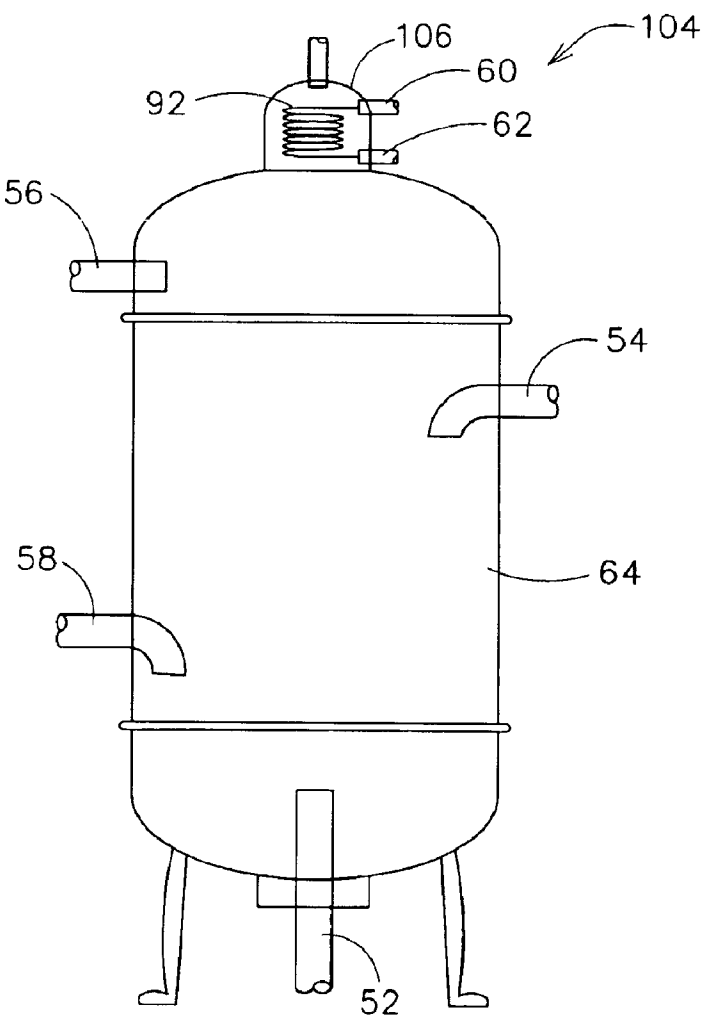
FIG. 9 is a side view of a schematic representation of components of the refrigeration system according to an exemplary embodiment.

Referring to FIG. 9, another configuration of an assembly 104 combining the separator and the standby condenser-evaporator is shown according to an exemplary embodiment. Assembly 104 is similar to assembly 102 (as shown schematically in FIG. 8), and includes a recess 106 (e.g. bell, dome, shell, cap, etc.) in the uppermost portion of the vessel 64. The standby condenser-evaporator 92 is shown positioned generally within recess 106 for cooling and condensing vaporized secondary coolant within the separator when the standby condensing system is activated.

Figure 10:
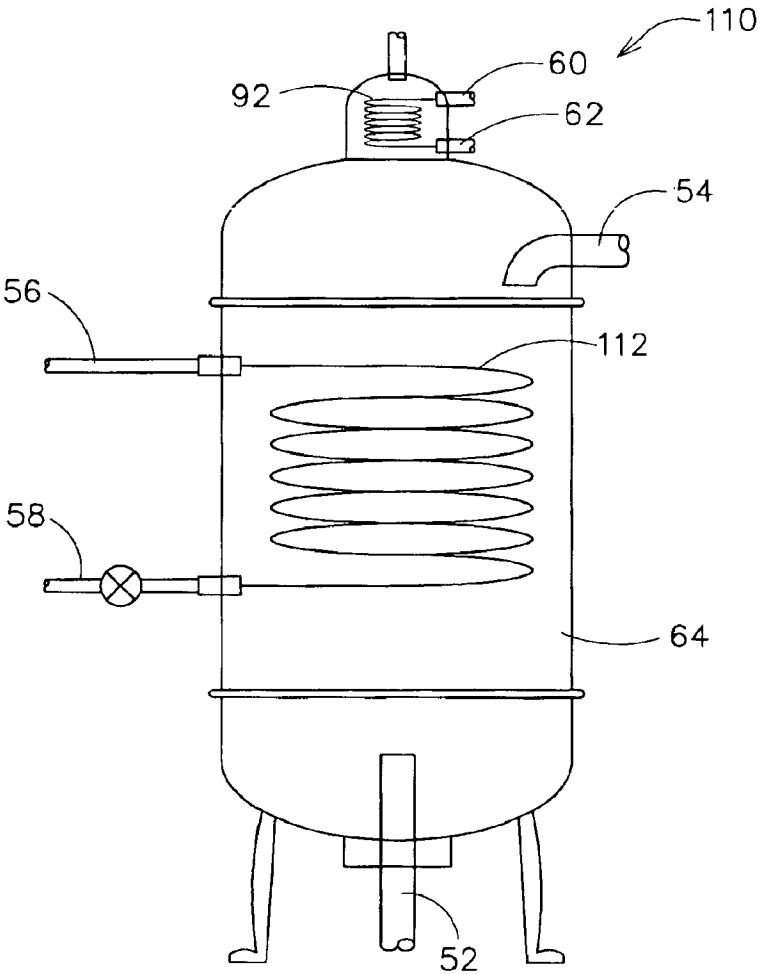
FIG. 10 is a side view of a schematic representation of components of the refrigeration system according to an exemplary embodiment.
Figure 12:
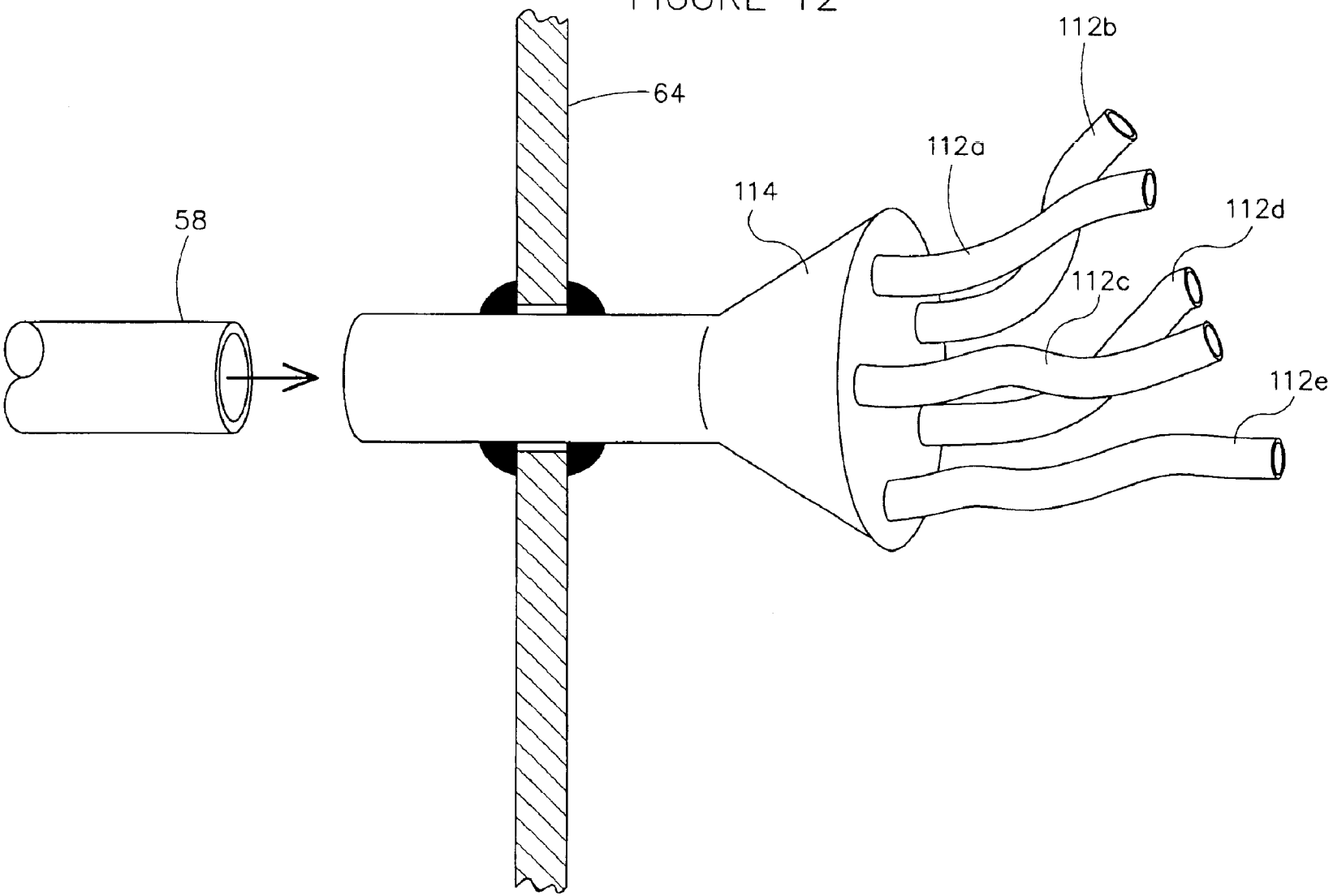
FIG. 12 is a side view of a schematic representation of components of the refrigeration system according to an exemplary embodiment.

Referring to FIG. 10, one configuration of an assembly 110 combining the separator, the standby condenser-evaporator, and the main condenser-evaporator is shown according to an exemplary embodiment. Assembly 110 is similar to assembly 104 (see FIG. 9) and includes a heat exchanger (e.g. tube coil, etc.) having a heat transfer surface area configured to function as the main condenser-evaporator. The heat exchanger main condenser-evaporator is shown schematically as a tube-coil 112 designed with a sufficient size and capacity to replace an external main condenser-evaporator. According to one embodiment, tube-coil 112 may be a single-pass tube-coil for circulating the refrigerant and cooling the heat transfer surface to provide cooling and condensation of the secondary coolant in a vapor state. According to another embodiment, tube-coil 112 may be a multiple-pass tube-coil or multiple tube-coils having a distributor device 114 for interconnection with the refrigerant supply line 58 to circulate an approximately even flow of refrigerant through the tube-coil(s) (see FIG. 12). Distributor device 114 is intended to act as a "header" or "manifold" for distributing the flow of refrigerant from refrigerant supply line 58, through the multiple tube-coils, and back to refrigerant return line 56. Distributor device 114 is shown schematically as having a generally truncated-cone shape, but may have any suitable shape and configuration for distributing a flow of refrigerant from a supply line, through multiple tube-coils, such as may be commercially available. According to an alternative embodiment, the heat exchanger functioning as the main condenser-evaporator may have any suitable shape and form (such as a tube-coil, multiple tube-coils, or other heat exchanger design, finned surfaces, etc.). For example, the heat exchanger may be built in or surrounding the wall of the vessel, or may be any suitable heat exchange device located in relation to the vessel to condense vaporized secondary coolant. The heat exchanger functioning as the main condenser-evaporator may be located at any suitable position in relation to the vessel for cooling and condensing vaporized secondary coolant.

Figure 11:
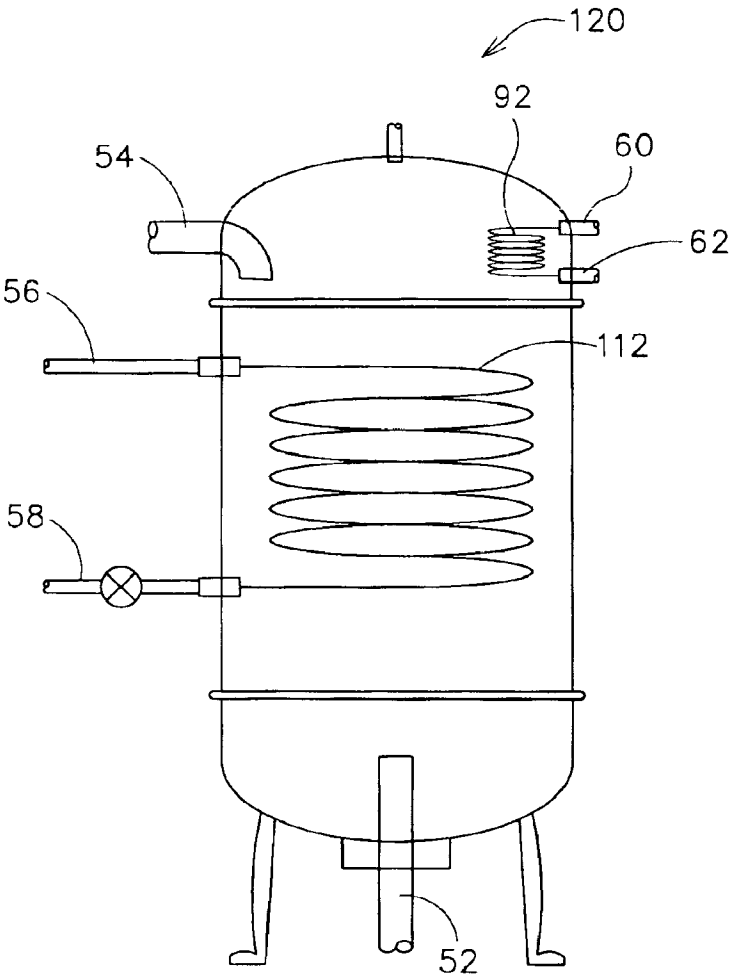
FIG. 11 is a side view of a schematic representation of components of the refrigeration system according to an exemplary embodiment.

Referring to FIG. 11, another configuration of an assembly 120 combining the separator, the standby condenser-evaporator and the main condenser-evaporator is shown according to an exemplary embodiment. Assembly 120 is similar to assembly 110 (as shown schematically in FIG. 10) and assembly 102 (as shown schematically in FIG. 8).

Figure 13:
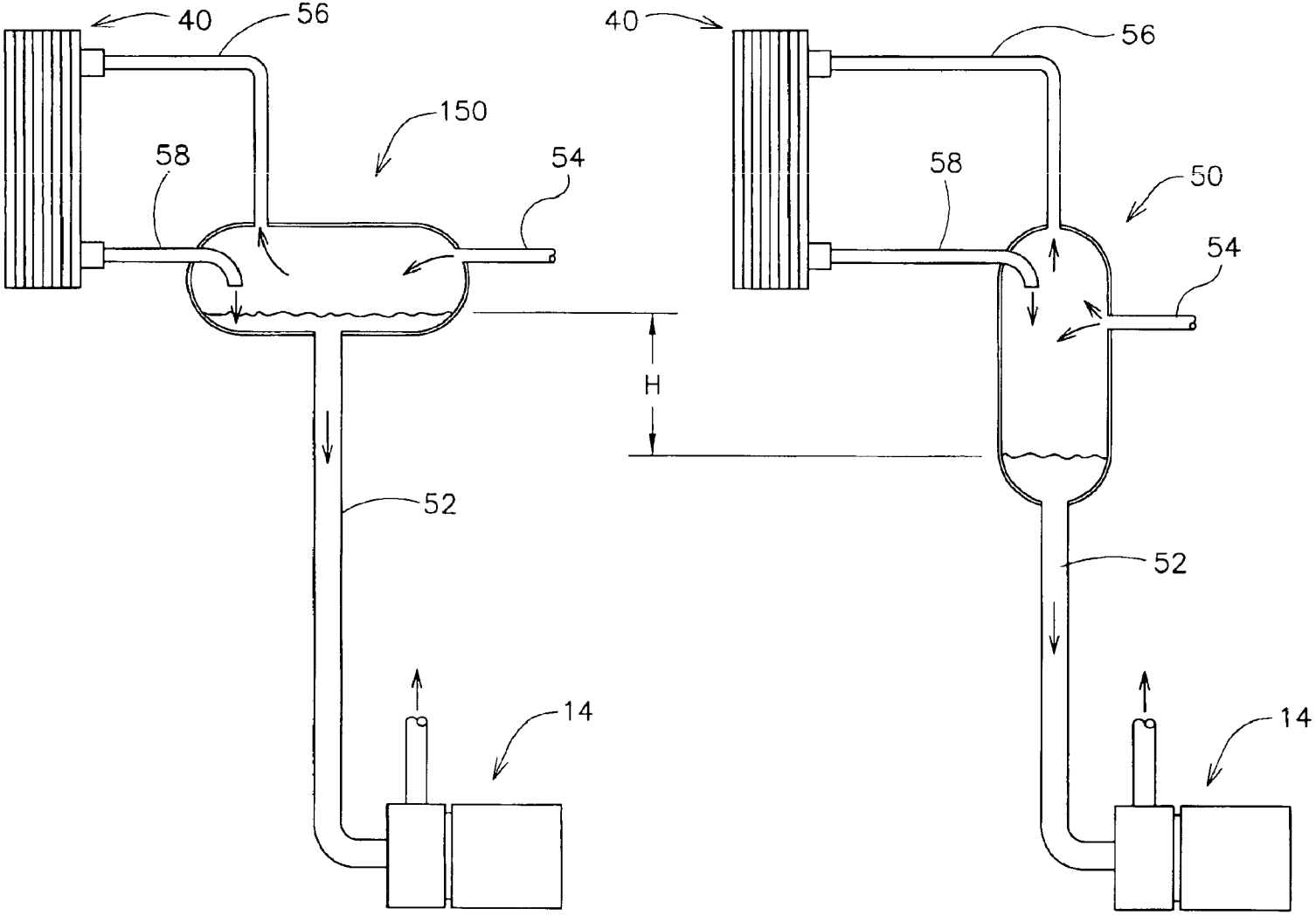
FIG. 13 is a side view of a schematic representation of components of the refrigeration system according to a preferred embodiment.

Referring to FIG. 13, a separator 150 is shown in a generally horizontal configuration according to an exemplary embodiment. In certain applications it may be desirable to provide a separator that occupies less vertical space than a vertically-oriented separator (e.g. where a refrigeration system is provided in a facility having limited vertical space, such as a mechanical enclosure located on a rooftop, etc.). In such applications the height of the overall assembly of components of the refrigeration system is typically related to the amount of net positive suction head (NPSH) required by a pump for circulating the secondary coolant (for systems provided with a pump), or to the amount of head required to circulate a sufficient gravity-induced rate of flow of the secondary coolant (for systems without a pump). Separator 150 may be provided in a generally horizontal configuration intended to elevate the level of the liquid relative to a pump or refrigeration device. Elevation of the level of liquid in the horizontal separator device (represented schematically by "H") is intended to increase the amount of head available for use with the system, then may otherwise be available for vertically-oriented separators within a space having limited vertical space.

Figure 14:
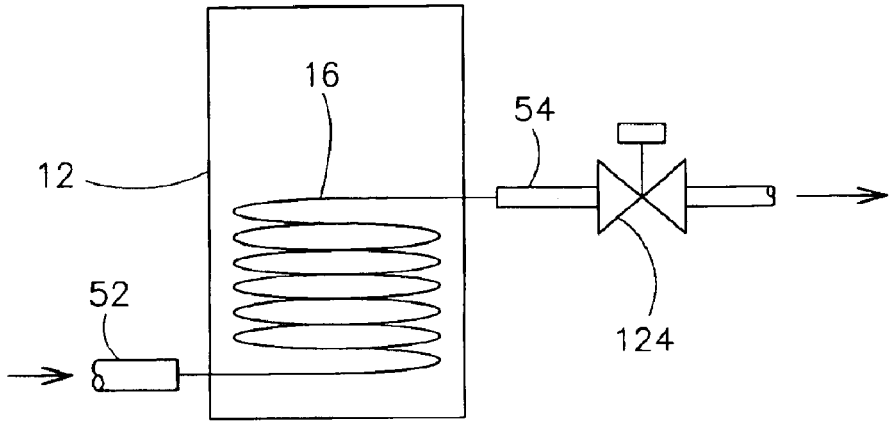
FIG. 14 is a schematic representation of components of the refrigeration system according to an exemplary embodiment.

Referring to FIG. 14, a valve assembly for use in improving defrost times for defrosting a cooling interface in refrigeration device 12 is shown according to an exemplary embodiment. In a typical refrigeration device, a frost buildup tends to occur on the surfaces of the cooling interface (e.g. cooling coil, etc.) in the refrigeration device as moisture in the air condenses and freezes on the surfaces of the cooling interface. Such typical refrigeration devices often provide flow regulating devices (e.g. valves, solenoid operated valves, etc.) to stop the flow of coolant to the cooling interface prior to initiation of a defrosting cycle in which a source of heat is provided to melt the frost/ice from the surfaces of the cooling interface. Stopping the flow of refrigerant is intended to minimize removal of such heat by the coolant so that the effectiveness of the defrosting process is enhanced. Such typical refrigeration devices often have a cooling interface in the form of a tube-coil that is circuited having an inlet at the bottom of the coil and an outlet at the top of the coil. In such a typical system a valve is located at the inlet to the tube-coil and is closed prior to initiating the defrost cycle. The liquid coolant that remains in the coil tends to slowly evaporate and move into a return line that exits at the top of the tube-coil and then the defrosting process is initiated.

In applications where a significant amount of liquid coolant remains in the coil, the time required to clear the coolant from the coil by vaporization may be excessive, leading to warming of the products that are stored in the refrigeration device. According to the embodiment shown in FIG. 14, a valve 124 (e.g. solenoid valve, etc.) is provided on coolant return line 54 at an upper, outlet side of cooling interface 16. It is believed that when valve 124 is closed, and the coolant begins to vaporize, the expanding volume of the vaporizing coolant tends to move (e.g. "force," etc.) the remaining liquid coolant in the tube-coil from the bottom portion of the tube-coil and into supply line 52, thus decreasing the amount of time necessary to clear the liquid coolant from the coil or other element of cooling interface 16 and permitting a more rapid initiation of the defrost process.

Figure 15:
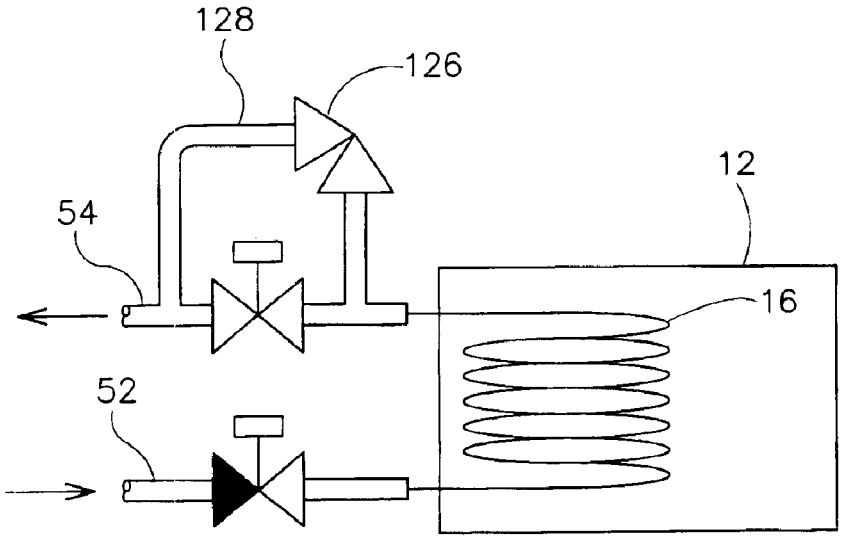
FIG. 15 is a schematic representation of components of the refrigeration system according to an exemplary embodiment.

Referring to FIG. 15, a pressure relief system for a refrigeration device is shown according to an exemplary embodiment. In a typical refrigeration system, a valve (e.g. isolation valve) is provided on the inlet and the outlet of a cooling interface to permit isolation of the cooling interface to facilitate installation, maintenance, troubleshooting, or cleaning of individual cooling interface(s) in a refrigeration device. In a refrigeration system using CO2 or other high-pressure refrigerant as a coolant, potential damage to the cooling interface may occur when the refrigerant trapped in the cooling interface by the isolation valves expands under the influence of ambient temperature conditions. In such typical refrigeration devices, over-pressure protection devices (e.g. relief valves, etc.) are placed on the cooling interface (e.g. tube-coil) and vented to a "safe" area (e.g. atmosphere external to a store, etc.) to relieve pressure within the coil if predetermined pressure limits are exceeded. Such typical relief valve configurations tend to result in unrecoverable loss of the coolant charge and require repair or replacement of the relief valve. According to the embodiment shown in FIG. 15, a relief valve 126 is provided adjacent cooling interface 16 and has a return 120 or "discharge" routed to return line 54 from cooling interface 16. In the event that a pressure condition within the cooling interface causes the relief valve to open, the discharged coolant is directed back to the coolant piping to prevent loss of the coolant, reduce the need to recharge the system, and reduce the time duration that the system is out of service. According to an alternative embodiment, the discharge of the relief valve may be configured to return the discharged coolant to a supply line for the coolant.

Figure 16A:
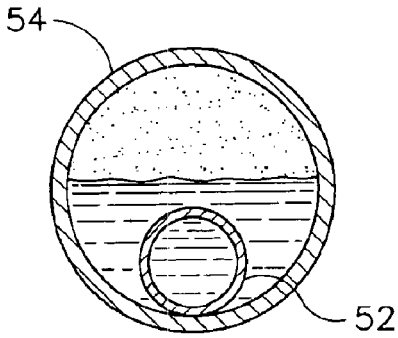
FIG. 16A is a schematic representation of components of the refrigeration system according to an exemplary embodiment.
Figure 16B:
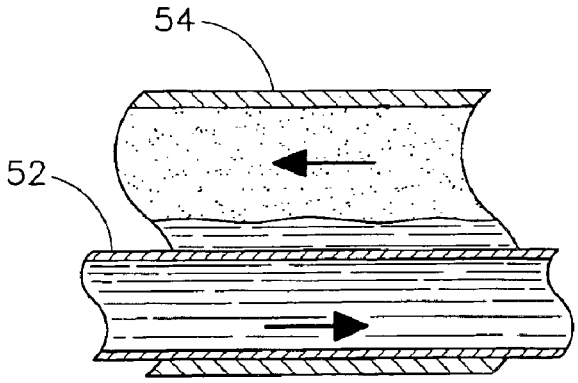
FIG. 16B is a schematic representation of components of the refrigeration system shown in FIG. 16A according to an exemplary embodiment.

Referring to FIG. 16, a piping system for a coolant is shown according to an exemplary embodiment. In conventional refrigeration systems, the refrigeration devices are typically located at a significant distance from the other components of the system and often require installation and insulation of long coolant supply lines and coolant return lines. Referring to FIGS. 16A and 16B, a piping system is shown that is intended to permit installation and insulation of only a single pipe between the refrigeration device and other components of the system. As shown schematically, supply line 52 has a first diameter and is intended to provide coolant in a substantially liquid state to the refrigeration device. Coolant return line 54 has a second diameter and is intended to return the coolant in a combined liquid-vapor or vapor state (depending on the circulation rate) from the refrigeration device. Supply line 52 may be routed within return line 54 so that a single pipe may be installed and insulated. The configuration shown schematically in FIGS. 16A and 16B is intended to be useful in systems where the difference in temperature between the coolant supply and the coolant is return is minimized (e.g. a circulation rate greater than 1.0, etc.).

Referring to Table 1, sizing and design considerations and parameters for the refrigeration system having CO2 as a coolant are shown according to an exemplary embodiment.

Figure 5:
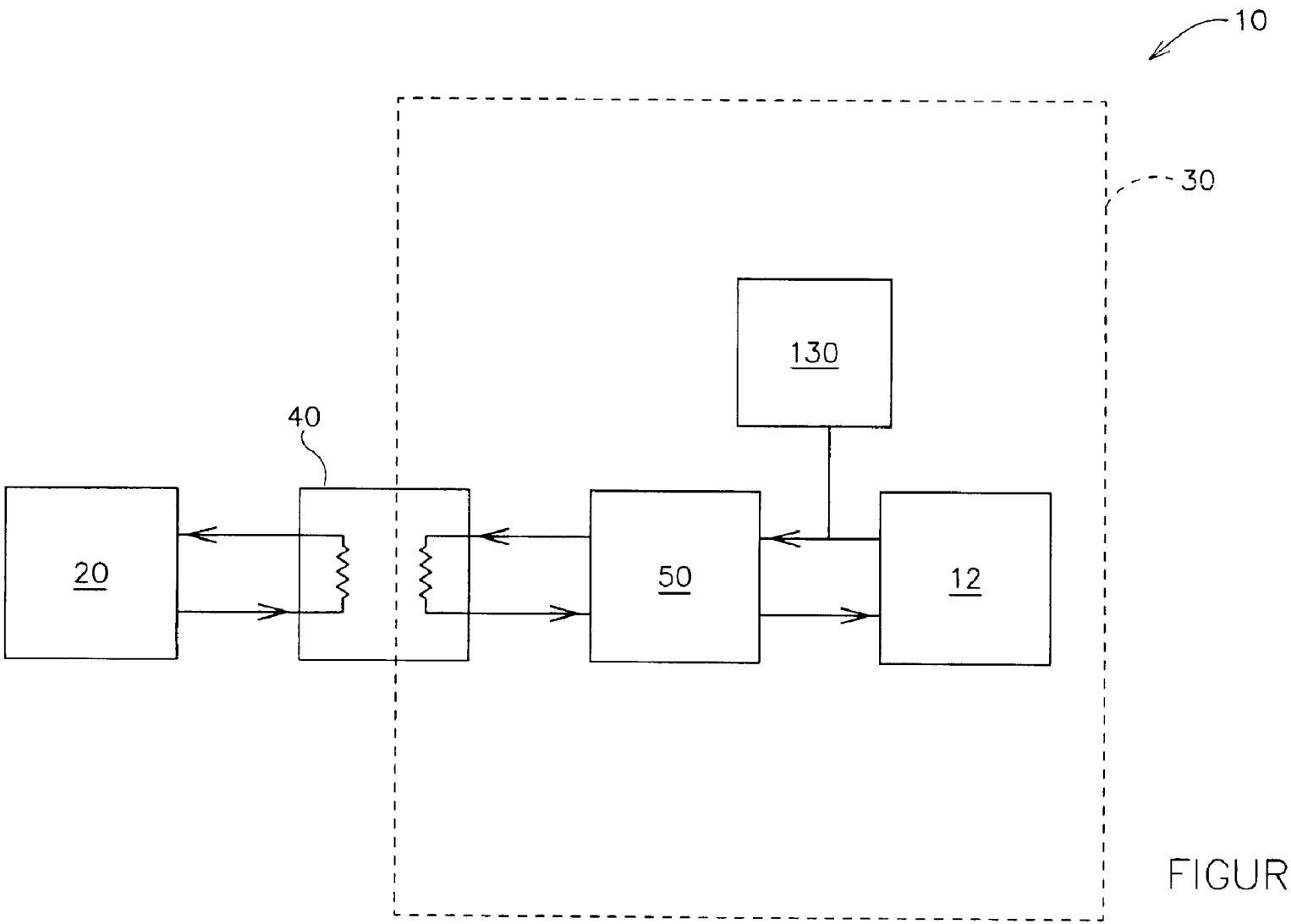
FIG. 5 is a schematic diagram of a refrigeration system according to another preferred embodiment.

Referring to FIGS. 5 through 7, a refrigeration system 10 having a primary refrigeration system 20 and a secondary cooling system 30 is shown according to another preferred embodiment. Secondary cooling system 30 includes a condenser-evaporator 40, a separator 50, at least one refrigeration device 12, and a vessel 130 (such as a fade-out vessel, container, expansion tank, etc.). Vessel 130 is configured to accommodate an increase in temperature of the secondary coolant in the event that primary refrigeration system 20 is or becomes unavailable to maintain the coolant at a temperature that is below a predetermined (e.g. "maximum," etc.) design temperature. Vessel 130 is sized to provide sufficient volume on the "vapor portion" of secondary cooling system 30 so that the pressure of the mass of coolant resulting from an increased temperature of the coolant (e.g. "maximum" ambient temperature, etc.) will be maintained with the pressure limits of the components of secondary cooling system 30. Vessel 130 permits a coolant such as CO2 to be used as a secondary coolant at generally low pressures that are intended to be within the design pressure limitations of many conventional refrigeration components. According to a particularly preferred embodiment, in the event that the primary refrigeration system becomes unavailable, vessel 130 has a volume that maintains the pressure of the coolant below a maximum pressure of 450 pounds per square inch gage (psig) when the temperature of the coolant rises toward ambient temperature conditions. Vessel 130 is sized to permit the temperature of the coolant to reach ambient design temperatures without exceeding the pressure limitations of the components of the secondary cooling system, and without the use of a standby or auxiliary condensing system. According to an alternative embodiment, an auxiliary condensing system may be used in combination with a vessel to increase the design options and performance characteristics of the secondary cooling system. According to another alternative embodiment, the vessel may be a replaced with an expansion device (e.g. expansion tank, etc.) that has a volume that increases to allow expansion of the coolant when the temperature of the coolant increases to limit the pressure of the coolant within an acceptable pressure range.

Referring further to FIGS. 5 and 6, the refrigeration system includes primary refrigeration system 20 and secondary cooling system 30. Primary refrigeration system 20 includes conventional refrigeration equipment configured to a cool and route a primary refrigerant to a heat exchanger (shown schematically as a condenser-evaporator device 40, which may be a tube-coil, plate-type or other suitable type of heat exchanger). According to a particularly preferred embodiment, the primary refrigeration system is a direct expansion system with a refrigerant (such as R-507 or ammonia) having a temperature at the inlet to the condenser-evaporator of approximately −25 deg F. [below zero] (or lower). The primary refrigeration system may include an evaporation pressure regulator of a conventional type. The primary refrigeration system may be provided at any suitable location such as on the roof of a facility (e.g. supermarket, grocery store, etc.) or in an equipment room within the facility or other suitable location that provides an elevated source of primary cooling such that the secondary coolant may operate in a natural circulation pattern (e.g. gravity and or temperature gradients, etc.). The primary refrigeration system is operated and controlled in a conventional manner to provide the desired cooling to the condenser-evaporator, in response to the heat load on the condenser-evaporator from the secondary cooling system. According to an alternative embodiment, the primary refrigerant may be configured for delivery to the condenser-evaporator at any suitable temperature to fulfill the thermal performance requirements of the system.

Referring further to FIGS. 5 and 6, secondary cooling system 30 includes a coolant adapted to circulate to condenser-evaporator 40, a separator 50 (shown schematically as a liquid-vapor separator device—see FIG. 7), at least one refrigeration device 12, and vessel 130 (shown schematically as a fade-out vessel). According to a particularly preferred embodiment, secondary cooling system 30 may interface with a single refrigeration device 12 (see FIG. 6) or with several devices. The use of a single or small number of refrigeration devices improves the practicality of using a vessel by permitting a relatively "small" amount of coolant to be used. The "small" amount of coolant can be more readily accommodated by a vessel having a reasonably practical size, in the event that the primary refrigeration system is unavailable. In comparison, systems having large or multiple refrigeration devices typically require a larger quantity of coolant and thus a correspondingly larger fade-out vessel, which may not be commercially practical for certain large systems.

According to a particularly preferred embodiment, condenser-evaporator 40 is provided at an elevated location above the components of secondary cooling system 30 (e.g. on a roof, in an overhead area, etc.) to promote a "natural" circulation of the coolant by gravity flow and temperature gradients. The system may be provided with a secondary coolant pump (shown schematically for example as pump 132) or may be configured for natural circulation (e.g. non-compression). For applications involving a single refrigeration device 12, such as a walk-in cooler or other enclosed space, the natural circulation of the coolant may be sufficient to circulate the coolant within the secondary cooling system and coolant flow devices, such as pumps, etc. may be omitted.

According to a particularly preferred embodiment, the secondary coolant is carbon dioxide (CO2) defined by ASHRAE as refrigerant R-744 that is maintained below a predetermined maximum design temperature that corresponds to a pressure that is suitable for use with conventional refrigeration and cooling equipment (e.g. cooling coils and evaporators in the refrigeration device, the condenser-evaporator, valves, instrumentation, piping, etc.). Use of CO2 within a temperature range that corresponds to a pressure within the limitations of conventional refrigeration equipment allows the system to be assembled from generally commercially available components (or components which can be readily fabricated) and tends to avoid the expense and time associated with custom designed and manufactured equipment that would otherwise be required for use with CO2 at pressure levels that correspond to normal ambient temperature levels. The primary refrigeration system maintains the coolant at a suitable temperature for use in providing cooling to the refrigeration devices, and well below the temperature of the coolant that corresponds to the pressure limitations of the equipment. According to a particularly preferred embodiment, the predetermined design temperature is approximately 22 degrees F., corresponding to a pressure of the coolant in the system of approximately 420 pounds per square inch gage (psig). In the event of unavailability of the primary refrigeration system (e.g. equipment malfunction, power loss, maintenance, defrost, etc.) the temperature of the coolant may begin to approach ambient temperature (typically well above the design temperature) resulting in a corresponding pressure increase.

Referring further to FIGS. 5 and 6, vessel 130 is shown according to one embodiment as connected to a portion of secondary cooling system 30 containing coolant in a vapor form or located at an elevation above the vapor portion of separator 50 so that vessel 130 contains secondary coolant in a vapor state only. According to a preferred embodiment, the vessel provides sufficient volumetric capacity to allow the secondary coolant to reach a pressure corresponding to ambient temperature design conditions that does not exceed a predetermined maximum pressure rating (e.g. 450 psig, etc.) of the piping and other components (e.g. separator, valves, cooling coils or evaporators in the refrigeration devices, etc.) of the secondary cooling system. The vessel may be a custom designed pressure vessel, or may be any commercially available volume (e.g. tank, cylinder, container, etc.) and may be made of any suitable material that is compatible with the secondary coolant and has sufficient volume and pressure capability to accommodate the coolant. According to an alternative embodiment, the vessel may be replaced with any suitable volume on the secondary cooling system. For example, the volume may be built in to the vapor side of the separator as an increased volume, or the piping on the vapor side of the secondary cooling system may have an increased size to provide sufficient volume to accommodate an increase in temperature of the coolant to ambient temperature design conditions without exceeding a predetermined pressure limit for the components of the secondary cooling system.

Referring to TABLE 2, a methodology for sizing the vessel is shown according to an exemplary embodiment. The methodology of TABLE 2 includes the following steps:

Select a secondary coolant (e.g. CO2, etc.) and identify the properties of the coolant from conventional tables for a design condition at ambient temperature and for a normal operating temperature condition.

Determine the cooling requirements of the system for the desired refrigeration device(s).

Determine the size of the piping and components according to the desired flow rates of the coolant and desired pressure drop of the coolant throughout the piping system.

Determine the volume of the components and piping of the secondary system and identify which components will contain the coolant in vapor form, liquid form, and mixed liquid vapor form.

Select a maximum working pressure (Pmax) and maximum system working temperature (Tmax) for the secondary coolant in the system.

Calculate (or determine from a pressure-enthalpy diagram) the specific volume (v) of the secondary coolant for the system corresponding to Pmax and Tmax.

Select the normal system operating pressure (P1) and normal system operating temperature (T1), which is the saturation temperature of the coolant corresponding to the specific volume.

Determine the quality (vapor fraction—shown as Xsys) of the secondary coolant. Select the required mass of secondary coolant liquid (Mliq) to operate the system at P1 and T1, from the volume of the piping and components in the portion of the secondary coolant system that is occupied by liquid coolant.

Calculate the total mass of coolant for the secondary coolant system (Msys) using Xsys (e.g. Msys=[Mliq/(1−Xsys)].

Calculate the total secondary coolant system volume (Vsys) based on the specific volume and the total mass [Vsys=(v)(Msys)].

Calculate the volume of the expansion vessel (Vexp) based on the total internal volume of the secondary system (Vreq) for example (Vexp=Vsys−Vreq).

To provide additional assurance that the pressure of the coolant in the secondary system will be maintained below the maximum design pressure, one or more pressure relief devices (e.g. relief valves, etc.) may be provided at appropriate locations throughout the secondary cooling system and are vented to open locations (e.g. outdoors, an area outside of the walk-in freezer or facility, etc.). The relief valves may be adjustable and set to regulate the CO2 pressure of the system at a predetermined level below the pressure limitations of the system.

Referring to FIG. 7, additional features and details of the separator are shown according to a preferred embodiment.

According to alternative embodiments, the refrigeration system may be a refrigerator, a freezer, a cold storage room, walk-in freezer, open or closed storage or display device such as "reach-in" coolers, etc. In other alternative embodiments, the coolant may be any suitable compound useful as a coolant in a refrigeration device and having generally non-harmful environmental characteristics. In further alternative embodiments, the standby condensing unit may be omitted, and a vessel or an expansion tank or other suitable storage device provided having sufficient volumetric capacity to accommodate the coolant or allow the coolant to expand, in the event that the primary refrigeration system is unavailable, such that the pressure of the coolant at normal ambient temperature conditions does not exceed the pressure limitations of the system.

It is important to note that the construction and arrangement of the elements of the refrigeration system provided herein are illustrative only. Although only a few exemplary embodiments of the present invention have been described in detail in this disclosure, those skilled in the art who review this disclosure will readily appreciate that many modifications are possible in these embodiments (such as variations in features such as components, coolant compositions, heat sources, orientation and configuration of refrigeration devices, location of components and sensors of the cooling and control systems; variations in sizes, structures, shapes, dimensions and proportions of the components of the system, use of materials, colors, combinations of shapes, etc.) without materially departing from the novel teachings and advantages of the invention. For example, closed or open space refrigeration systems may be used having either horizontal or vertical access openings, and cooling interfaces may be provided in any number, size, orientation and arrangement to suit a particular refrigeration system. According to other alternative embodiments, the refrigeration system may be any device using a refrigerant or coolant for transferring heat from one space to be cooled to another space or source designed to receive the rejected heat and may include commercial, institutional or residential refrigeration systems. Further, it is readily apparent that variations of the refrigeration system and its components and elements may be provided in a wide variety of types, shapes, sizes and performance characteristics, or provided in locations external or partially external to the refrigeration system. Accordingly, all such modifications are intended to be within the scope of the inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

TABLE 1

Refrigeration Loads:

| Ckt. | Description | Load [Btu/Hr] | % Load of Total | Case Mass Flow based on Recirc = 2 | |
|---|---|---|---|---|---|
| 1 | Island Freezer | 5,600 | 21.1% | 86 lb/hr = | 0.161 Gpm |
| 2 | Reach-In I.C. Case | 4,800 | 18.0% | 74 lb/hr = | 0.138 Gpm |
| 3 | Reach-In F.F. Case | 4,200 | 15.8% | 65 lb/hr = | 0.121 Gpm |
| 4 | 8' × 8' × 8' Walk-In I.C. Freezer | 6,000 | 22.6% | 93 lb/hr = | 0.173 Gpm |
| 5 | 8' × 8' × 8' Walk-In F.F. Freezer | 6,000 | 22.6% | 93 lb/hr = | 0.173 Gpm |
| | Total | 26,600 | 100% | | |

| $CO_2$ (R-744) Properties at −20° F. | | R-507 Properties for DX Evaporator | |
|---|---|---|---|
| $P_{saturation}$ = | 214.9 [Psia] | $P_{saturation}$ = | 32.7 [Psia] |
| or | 200.2 [Psig] | or | 18.0 [Psig] |
| $h_{liquid}$ = | 9.78 [Btu/Lb] | $h_{liquid}$ @ 50° F. = | 28.37 [Btu/Lb] |
| $h_{vapor}$ = | 139.4 [Btu/Lb] | $h_{vapor}$ @ −20° F. = | 85.07 [Btu/Lb] |
| $h_{vaporization}$ = | 129.6 [Btu/Lb] | $h_{refrigeration\ effect}$ = | 56.70 [Btu/Lb] |
| $\rho_{liquid}$ = | 66.86 [Lb/Ft$^3$] | $\rho_{liquid}$ @ 50° F. = | 69.67 [Lb/Ft$^3$] |
| $\rho_{vapor}$ = | 2.41 [Lb/Ft$^3$] | $\rho_{vapor}$ @ −20° F. = | 0.7444 [Lb/Ft$^3$] |
| $c_{p,\ liquid}$ = | 0.4975 [Btu/Lb° F.] | $c_{p,\ liquid}$ @ −20° F. = | 0.3027 [Btu/Lb° F.] |
| $c_{p,\ vapor}$ = | 0.2760 [Btu/Lb° F.] | $c_{p,\ vapor}$ @ −20° F. = | 0.2052 [Btu/Lb° F.] |
| If saturated liquid entering and saturated vapor leaving evaporator: | | | |
| Mass flow rate = | 205.2 [Lb/Hr] | Mass flow rate = | 469.2 [Lb/Hr] |
| or | 3.421 [Lb/Min] | or | 7.820 [Lb/Min] |
| Liquid Volume Flow = | 0.0512 [Ft$^3$/Min] | Liquid Volume Flow = | 0.1122 [Ft$^3$/Min] |
| or | 0.383 [Gpm] | or | 0.840 [Gpm] |
| Vapor Volume Flow = | 1.419 [Ft$^3$/Min] | Vapor Volume Flow = | 10.505 [Ft$^3$/Min] |
| or | 10.62 [Gpm] | or | 78.58 [Gpm] |
| To maintain 120 [Ft/Min] in Liquid Line: | | With a 1.5 circulation Rate: | |
| $CO_2$ Equiv. Line Size = | 0.28 [In Ø] | $CO_2$ Equiv. Liquid Line Size = | 0.34 [In Ø] |
| R-507 Eqiv. Line Size = | 0.41 [In Ø] | $CO_2$ Equiv. Vapor Line Size = | 0.63 [In Ø] |
| To maintain 1300 [Ft/Min] in Suction Line: | | We will Install: | |
| $CO_2$ Equiv. Line Size = | 0.45 [In Ø] | $CO_2$ Liquid Line Size = | ½ [In ID] |
| R-507 Eqiv. Line Size = | 1.22 [In Ø] | $CO_2$ Vapor Line Size = | ⅞ [In ID] |

Secondary Coolant Line Sizing
Refrigeration Loads:

| Ckt. | Description | Load [Btu/Hr] | % Load of Total |
|---|---|---|---|
| 1 | Island Freezer | 5,600 | 21.1% |
| 2 | Reach-In I.C. Case | 4,800 | 18.0% |
| 3 | Reach-In F.F. Case | 4,200 | 15.8% |
| 4 | 8' × 8' × 8' Walk-In I.C. Freezer | 6,000 | 22.6% |
| 5 | 8' × 8' × 8' Walk-In F.F. Freezer | 6,000 | 22.6% |
| | Total | 26,600 | 100% |

Cases use 54.9% of Total Load
Freezers use 45.1% of Total Load $CO_2$ (R-744) Properties at −20° F.:

| | |
|---|---|
| $P_{saturation}$ = | 214.9 [Psia] |
| or | 200.2 [Psig] |
| $h_{liquid}$ = | 9.78 [Btu/Lb] |
| $h_{vapor}$ = | 139.4 [Btu/Lb] |
| $h_{vaporization}$ = | 129.6 [Btu/Lb] |
| $\rho_{liquid}$ = | 66.86 [Lb/Ft$^3$] |
| $\rho_{vapor}$ = | 2.41 [Lb/Ft$^3$] |
| $c_{p,\ liquid}$ = | 0.4975 [Btu/Lb° F.] |
| $c_{p,\ vapor}$ = | 0.2760 [Btu/Lb° F.] |

Copper Pipe Dimensions:

| Pipe Size | Pipe Grade | Flow Area [In$^2$] | Flow Area [Ft$^2$] |
|---|---|---|---|
| ⅜" OD | Type L | 0.078 | 0.00054 |
| ½" OD | Type L | 0.145 | 0.00101 |
| ⅝" OD | Type K | 0.218 | 0.00151 |
| ⅞" OD | Type K | 0.436 | 0.00303 |
| 1−⅛" OD | Type K | 0.778 | 0.00540 |

TABLE 1-continued

Pipe Sizing Calculations:

| | Circulation Rate = 1 | Circulation Rate = 2 | Circulation Rate = 4 |
|---|---|---|---|
| Total System: | | | |
| Mass Flow Rate: | 205.2 [Lb/Hr] | 410.5 [Lb/Hr] | 820.9 [Lb/Hr] |
| Liq. Velocity, ⅜" OD | 1.57 [Ft/Sec] | 3.15 [Ft/Sec] | 6.30 [Ft/Sec] |
| Liq. Velocity, ½" OD | 0.85 [Ft/Sec] | 1.69 [Ft/Sec] | 3.39 [Ft/Sec] |
| Liq. Velocity, ⅝" OD | 0.56 [Ft/Sec] | 1.13 [Ft/Sec] | 2.25 [Ft/Sec] |
| Vap. Velocity, ⅝" OD | 938 [Ft/Min] | 1875 [Ft/Min] | 3750 [Ft/Min] |
| Vap. Velocity, ⅞" OD | 469 [Ft/Min] | 938 [Ft/Min] | 1875 [Ft/Min] |
| Vap. Velocity, 1–⅛" OD | 263 [Ft/Min] | 525 [Ft/Min] | 1051 [Ft/Min] |
| Display Cases: | | | |
| Mass Flow Rate: | 112.6 [Lb/Hr] | 225.3 [Lb/Hr] | 450.6 [Lb/Hr] |
| Liq. Velocity, ⅜" OD | 0.86 [Ft/Sec] | 1.73 [Ft/Sec] | 3.46 [Ft/Sec] |
| Liq. Velocity, ½" OD | 0.46 [Ft/Sec] | 0.93 [Ft/Sec] | 1.86 [Ft/Sec] |
| Liq. Velocity, ⅝" OD | 0.31 [Ft/Sec] | 0.62 [Ft/Sec] | 1.24 [Ft/Sec] |
| Vap. Velocity, ½" OD | 774 [Ft/Min] | 1547 [Ft/Min] | 3095 [Ft/Min] |
| Vap. Velocity, ⅝" OD | 515 [Ft/Min] | 1029 [Ft/Min] | 2058 [Ft/Min] |
| Vap. Velocity, ⅞" OD | 257 [Ft/Min] | 515 [Ft/Min] | 1029 [Ft/Min] |
| Vap. Velocity, 1–⅛" OD | 144 [Ft/Min] | 288 [Ft/Min] | 577 [Ft/Min] |
| Freezers: | | | |
| Mass Flow Rate: | 92.59 [Lb/Hr] | 185.17 [Lb/Hr] | 370.34 [Lb/Hr] |
| Liq. Velocity, ⅜" OD | 0.71 [Ft/Sec] | 1.42 [Ft/Sec] | 2.84 [Ft/Sec] |
| Liq. Velocity, ½" OD | 0.38 [Ft/Sec] | 0.76 [Ft/Sec] | 1.53 [Ft/Sec] |
| Liq. Velocity, ⅝" OD | 0.25 [Ft/Sec] | 0.51 [Ft/Sec] | 1.02 [Ft/Sec] |
| Vap. Velocity, ½" OD | 636 [Ft/Min] | 1272 [Ft/Min] | 2543 [Ft/Min] |
| Vap. Velocity, ⅝" OD | 423 [Ft/Min] | 846 [Ft/Min] | 1692 [Ft/Min] |
| Vap. Velocity. ⅞" OD | 211 [Ft/Min] | 423 [Ft/Min] | 846 [Ft/Min] |
| Vap. Velocity, 1–⅛" OD | 119 [Ft/Min] | 237 [Ft/Min] | 474 [Ft/Min] |

Charge Analysis $CO_2$ Properties (at −20° F.):

| | |
|---|---|
| Liquid Density: 66.84 [Lb/Ft$^3$] | Liquid Specific Volume: 0.0150 [Ft$^3$/Lb] |
| Vapor Density: 2.41 [Lb/Ft$^3$] | Vapor Sepecific Volume: 0.415 [Ft$^3$/Lb] |

Display Cases and Walk-Ins:

| Circuit | | Volume [Ft$^3$] | Liquid Vol. % | Liq. Vol. [Ft$^3$] | Charge [Lbs.] |
|---|---|---|---|---|---|
| 1A | Island (1/2 case) | 0.098 | 60% | 0.059 | 4.0 |
| 1B | Island (1/2 case) | 0.098 | 60% | 0.059 | 4.0 |
| 2 | Ice Cream | 0.282 | 60% | 0.169 | 11.6 |
| 3 | Frozen Food | 0.282 | 60% | 0.169 | 11.6 |
| 4 | 8' × 8' Ice Cream Freezer | 0.109 | 60% | 0.065 | 4.5 |
| 5 | 8' × 8' Frozen Food Freezer | 0.109 | 60% | 0.065 | 4.5 |
| | Totals: | 0.977 | | 0.586 | 40.1 |

Connecting Piping:

| Item | Pipe Size | Flow Area [In$^2$] | Length [Ft] | Volume [Ft$^3$] | Liquid Vol. %** | Liq. Vol. [Ft$^3$] | Charge [Lbs.] |
|---|---|---|---|---|---|---|---|
| Main Supply to Tee | ½" OD Type L | 0.145 | 75 | 0.076 | 100% | 0.076 | 5.0 |
| Tee Supply to Cases | ⅜" OD Type L | 0.078 | 80 | 0.043 | 100% | 0.043 | 2.9 |
| Tee Supply to Freezers | ⅜" OD Type L | 0.078 | 80 | 0.043 | 100% | 0.043 | 2.9 |
| Return Cases to Tee | ⅝" OD Type K | 0.218 | 80 | 0.121 | 4% | 0.005 | 0.6 |
| Return Freezers to Tee | ⅝" OD Type K | 0.218 | 80 | 0.121 | 4% | 0.005 | 0.6 |
| Main Return from Tee | ⅞" OD Type K | 0.436 | 75 | 0.227 | 4% | 0.009 | 1.1 |
| Totals: | | | 470 | 0.631 | | 0.181 | 13.2 |

** Return Line Liquid Volume % based on Circulation Rate of 2, equal mass of liquid and vapor Charge Summary:

| | |
|---|---|
| Coils | 40.1 [Lbs.] |
| Piping | 13.2 [Lbs.] |
| Total Charge | 53.3 [Lbs.] |

TABLE 1-continued

| | | | | |
|---|---|---|---|---|
| ASHRAE-15 Concentrations Calculations | | | | |
| According to ANSI/ASHRAE Standard 15–2001, Table 1: | | | | |
| R-744 ($CO_2$) is limited to 50,000 ppm or 5.7 Lb/1000 $Ft^3$ | | | | |
| Our total system charge is: | | 60 [Lb] | | |
| At STP, gas density is: | | 8.8 [$Ft^3$/Lb] | | |
| Volume if 100% vaporized is: | | 525 [$Ft^3$] | | |
| Lab Evaluation by Room: | Room #1 | Room #2 | Room #3 | Room #4 |
| Room Volume: | 27,600 [$Ft^3$] | 25,800 [$Ft^3$] | 13,030 [$Ft^3$] | 512 [$Ft^3$] |
| Conc. During Total Leak: | 1.90 [%] | 2.03 [%] | 4.03 [%] | 102.54 [%] |
| Conc. In PPM: | 19,022 [ppm] | 20,349 [ppm] | 40,292 [ppm] | 1,025,391 [ppm] |

Relief Valve Capacity Calculations

| | |
|---|---|
| Valve Specifications: | |
| Model: | SS-4R3A5-NE |
| Manufacturer: | Swagelok |
| R-744 Properties @420 Psig | |
| Saturation Temperature: | 22 [° F.] |
| Liquid Density | 59.9 [Lb/$Ft^3$] |
| Vapor Density | 5.11 [Lb/$Ft^3$] |
| Liquid Enthalpy: | 31.8 [Btu/Lb] |
| Vapor Enthalpy: | 138.0 [Btu/Lb] |
| Heat of Vaporization: | 106.2 [Btu/Lb] |

Relief Valve Heat Capacity by Varying Flow Rate:

| RELIEF RATE [CFM] | VAPOR FLOWRATE [$Ft^3$/Hr] | VAPOR MASSFLOW [Lb/Hr] | HEAT FLOW [Btu/Hr] |
|---|---|---|---|
| 0.1 | 6 | 31 | 3,258 |
| 0.2 | 12 | 61 | 6,516 |
| 0.5 | 30 | 153 | 16,289 |
| 1 | 60 | 307 | 32,578 |
| 2 | 120 | 613 | 65,156 |

TABLE 2

Carbon Dioxide Secondary Coolant System with Fade-Out Vessel

Refrigerant Properties:

| $CO_2$ (R-744) Properties[1] at −20° F. | | $CO_2$ (R-744) Properties[1] at +75° F. | |
|---|---|---|---|
| $P_{saturation}$ = | 214.9 [Psia] | $P_{saturation}$ = | 909.6 [Psia] |
| or | 200.2 [Psig] | or | 894.9 [Psig] |
| $h_{liquid}$ = | 9.78 [Btu/Lb] | $h_{liquid}$ = | 67.7 [Btu/Lb] |
| $h_{vapor}$ = | 139.4 [Btu/Lb] | $h_{vapor}$ = | 122.7 [Btu/Lb] |
| $h_{vaporization}$ = | 129.6 [Btu/Lb] | $h_{vaporization}$ = | 55.0 [Btu/Lb] |
| $\rho_{liquid}$ = | 66.86 Lb/$Ft^3$] | $\rho_{liquid}$ = | 45.36 [Lb/$Ft^3$] |
| $\rho_{vapor}$ = | 2.41 [Lb/$Ft^3$] | $\rho_{vapor}$ = | 14.35 [Lb/$Ft^3$] |
| $c_{p,\ liquid}$ = | 0.4975 [Btu/Lb° F.] | $c_{p,\ liquid}$ = | 1.363 [Btu/Lb° F.] |
| $c_{p,\ vapor}$ = | 0.2760 [Btu/Lb° F.] | $c_{p,\ vapor}$ = | 1.659 [Btu/Lb° F.] |

[1]Properties from 2001 ASHRAE Fundamentals Handbook, p. 20.35

System Design:

| | |
|---|---|
| Total Load (Max.) = | 24,000 [Btu/Hr] |
| or = | 2.0 [Tons Refrigeration] |
| Assuming Saturated Vapor Entering Condenser, | |
| Saturated Liquid Leaving Condenser: | |
| Cond. Mass Flow = | 185 [Lb/Hr] |
| or = | 3.09[Lb/Min] |
| Liquid Volume Flow = | 0.0462 [$Ft^3$/Min] |
| or = | 0.00077 [$Ft^3$/Sec] |
| Vapor Volume Flow = | 1.28 [$Ft^3$/Min] |
| or = | 0.0213 [$Ft^3$/Sec] |

TABLE 2-continued

Carbon Dioxide Secondary Coolant System with Fade-Out Vessel

Line Sizing:

| PIPE SIZE | TYPE | FLOW AREA[2] | LIQUID VELOCITY | | VAPOR VELOCITY | | VOLUME |
|---|---|---|---|---|---|---|---|
| [OD] | [L or K] | [In$^2$] | [Ft/Sec] | [Ft/Min] | [Ft/Sec] | [Ft/Min] | [Ft$^3$/Ft] |
| ⅜" | L | 0.078 | 1.42 | 85.2 | 39.4 | 2364 | 0.000542 |
| ½" | L | 0.145 | 0.764 | 45.8 | 21.2 | 1272 | 0.00101 |
| ⅝" | L | 0.233 | 0.475 | 28.5 | 13.2 | 791 | 0.00162 |
| ⅞" | L | 0.484 | 0.229 | 13.7 | 6.35 | 381 | 0.00336 |
| 1–⅛" | K | 0.778 | 0.142 | 8.54 | 3.95 | 237 | 0.00540 |
| 1.5" | Sch. 80 | 1.77 | 0.0626 | 3.76 | 1.74 | 104 | 0.0123 |
| 2" | Sch. 80 | 2.95 | 0.0376 | 2.25 | 1.04 | 62.5 | 0.0205 |
| 2.5" | Sch. 80 | 4.24 | 0.0261 | 1.57 | 0.725 | 43.5 | 0.0294 |
| 3" | Sch. 80 | 6.60 | 0.0168 | 1.01 | 0.466 | 27.9 | 0.0458 |
| 4" | Sch. 80 | 11.5 | 0.0096 | 0.58 | 0.267 | 16.0 | 0.0799 |
| 6" | Sch. 40 | 28.9 | 0.0038 | 0.23 | 0.106 | 6.4 | 0.2006 |
| 8" | Sch. 40 | 50.0 | 0.0022 | 0.13 | 0.061 | 3.7 | 0.3474 |
| 10" | Sch. 40 | 78.9 | 0.0014 | 0.08 | 0.039 | 2.3 | 0.5476 |
| 12" | Sch. 40 | 111.9 | 0.0010 | 0.06 | 0.027 | 1.6 | 0.7771 |

[2]Flow Area from 2000 ASHRAE Systems and Equipment Handbook, p. 41.3-4

System Schematic:

Charge Analysis:

Properties @ +75° F. 450 Psig:

Vapor Density, $\rho_{vapor}$: = 5.2 [Lb/Ft$^3$]

Properties @ −20° F.

Liquid Density, $\rho_{liquid}$: = 66.86 [Lb/Ft$^3$]

Vapor Density, $\rho_{vapor}$: = 2.41 [Lb/Ft$^3$]

Quality at 5.2 [Lb/Ft$^3$] = 0.43 (from P-h diagram)

| ITEM # | COMPONENT DESCRIPTION | INTERNAL VOLUME [Ft$^3$] | | LIQUID CHARGE [Lbs.] |
|---|---|---|---|---|
| 1 | Heat Exchanger | 0.117 | | 1.96 |
| 2 | Evaporator | 0.109 | | 3.64 |
| 3 | ⅜" Type L Copper Tube, 2' Long | 0.0011 | | 0.07 |
| 4 | ⅝" Type L Copper Tube. 2' Long | 0.0032 | | 0.00 |
| 5 | ⅜" Type L Copper Tube, 4' Long | 0.0022 | | 0.14 |
| 6 | ⅝" Type L Copper Tube, 4' Long | 0.0065 | | 0.00 |
| 7 | Hill PHOENIX Liquid-Vapor Separator | 0.0218 | | 0.15 |
| | | 0.261 | Total | 5.96 |
| | | | Liquid R-744 Charge = | |

Total System Mass for above liquid mass and system density: 10.46 [Lb]

Required System Volume to hold total charge: 2.01 [Ft$^3$]

Required Volume of Fade-Out Vessel: 1.75 [Ft$^3$]

Carbon Dioxide Secondary Coolant System with Fade-Out Vessel System Schematic:

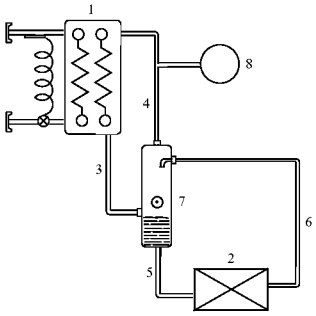

Charge Analysis:

Properties @ +75° F., 450 Psig:

Vapor Density, $\rho_{vapor}$: = 5.2 [Lb/Ft$^3$]

Properties @ −20° F.

Liquid Density, $\rho_{liquid}$: = 66.86 [Lb/Ft$^3$]

Vapor Density, $\rho_{vapor}$: = 2.41 [Lb/Ft$^3$]

Quality at 5.2 [Lb/Ft$^3$] = 0.43 (from P-h diagram)

| ITEM # | COMPONENT DES-CRIPTION | INTERNAL VOLUME [Ft$^3$] | | LIQUID CHARGE [Lbs.] |
|---|---|---|---|---|
| 1 | Heat Exchanger | 0.117 | | 1.96 |
| 2 | Evaporator | 0.109 | | 3.64 |
| 3 | ⅜" Type L Copper Tube, 2' Long | 0.0011 | | 0.07 |
| 4 | ⅝" Type L Copper Tube, 2' Long | 0.0032 | | 0.00 |
| 5 | ⅜" Type L Copper Tube, 4' Long | 0.0022 | | 0.14 |
| 6 | ⅝" Type L Copper Tube, 4' Long | 0.0065 | | 0.00 |
| 7 | Hill PHOENIX | 0.0218 | | 0.15 |
| | Liquid-Vapor Separator | 0.261 | Total Liquid R-744 Charge = | 5.96 |

Total System Mass for above liquid mass and system density: 10.46 [Lb]

Required System Volume to hold total charge: 2.01 [Ft$^3$]

Required Volume of Fade-Out Vessel: 1.75 [Ft$^3$]

SIZING PROCESS ON PRESSURE ENTHALPY-DIAGRAM

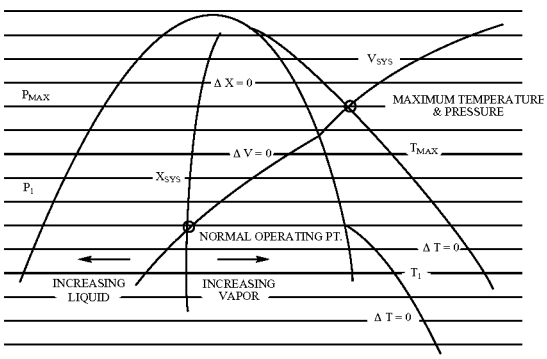

What is claimed is:

1. A refrigeration system for providing cooling to a refrigeration device, comprising:

a first cooling system having a refrigerant configured to communicate with a heat exchanger to provide a primary cooling source;

a second cooling system having a coolant configured to be cooled by the primary cooling source and circulated to the refrigeration device;

a separator device configured to receive the coolant from the refrigeration device and direct coolant in a vapor state to the heat exchanger and direct coolant in a liquid state to the refrigeration device.

2. The refrigeration system of claim 1 wherein the heat exchanger device is configured to at least partially condense the coolant.

3. The refrigeration system of claim 1 further comprising a third cooling system configured to provide an auxiliary cooling source to the coolant.

4. The refrigeration system of claim 3 wherein the third cooling system is a standby cooling system having a standby heat exchanger configured to condense at least a portion of the coolant.

5. The refrigeration system of claim 4, wherein the standby cooling system further comprises a backup power supply.

6. The refrigeration system of claim 3 wherein the standby heat exchanger and the separator are integrated as an assembly.

7. The refrigeration system of claim 3 wherein the standby heat exchanger and the separator and the heat exchanger device are integrated as an assembly.

8. The refrigeration system of claim 1 wherein the first cooling system is a direct expansion primary refrigeration system.

9. The refrigeration system of claim 1 wherein the coolant is carbon dioxide.

10. The refrigeration system of claim 1 wherein the coolant is circulated to the refrigeration device by a pump.

11. The refrigeration system of claim 10 wherein the pump is a variable speed pump controlled by a superheat condition of the coolant returning from the refrigeration device.

12. The refrigeration system of claim 1 wherein the coolant is circulated to the refrigeration device by natural circulation.

13. The refrigeration system of claim 1 further comprising a subcooler device communicating with the first cooling system and configured to condense at least a portion of the coolant circulated to the refrigeration device.

14. The refrigeration system of claim 1 wherein the second cooling system further comprises a charging system.

15. The refrigeration system of claim 1 wherein the heat exchanger device is located at an elevated position.

16. The refrigeration system of claim 1 wherein the auxiliary cooling source has a heat removal capability that is less than a heat removal capability of the primary cooling source.

17. The refrigeration system of claim 10 wherein the operation of the pump is stopped when operation of the third cooling system is initiated.

18. A refrigeration system, comprising:

a primary cooling system configured to circulate a refrigerant to a heat exchanger;

a secondary cooling system configured to circulate a coolant to the heat exchanger and at least one refrigeration device;

a separator configured to direct a vapor portion of the coolant to the heat exchanger and a liquid portion of the coolant to the refrigeration device;

a third cooling system configured to cool a vapor portion of the coolant from the secondary cooling system.

19. The refrigeration system of claim 18 wherein the coolant comprises a compound that is found in the atmosphere.

20. The refrigeration system of claim 18 wherein the coolant comprises carbon dioxide.

21. The refrigeration system of claim 18 wherein the coolant comprises a carbon dioxide blend.

22. The refrigeration system of claim 18 wherein the third cooling system is configured to cool at least a portion of the coolant when the primary cooling system is incapable of maintaining a temperature of the coolant below a predetermined temperature.

23. The refrigeration system of claim 18 wherein the refrigerant comprises a direct expansion refrigerant.

24. The refrigeration system of claim 18 wherein the refrigeration device is a low temperature device.

25. The refrigeration system of claim 18 wherein the refrigeration device is a medium temperature device.

26. The refrigeration system of claim 18 wherein the refrigeration device is a plurality of refrigeration devices and further comprising at least one flow control device configured to regulate a flow of the coolant to the one or more of the plurality of refrigeration devices.

27. The refrigeration system of claim 18 wherein the refrigeration device comprises a cooling interface configured to receive the coolant to provide cooling to a space within the refrigeration device.

28. The refrigeration system of claim 27 wherein the cooling interface comprises a valve on an outlet of the cooling interface configured to permit the coolant to expand toward an inlet of the cooling interface when the valve is closed so that a liquid portion of the coolant is removed from the cooling interface prior to a defrost operation.

29. The refrigeration system of claim 18 wherein the secondary cooling system comprises at least one pressure relief device.

30. The refrigeration system of claim 29 wherein the pressure relief device comprises a relief valve.

31. The refrigeration system of claim 30 wherein a discharge of the coolant from the relief valve is configured to be returned to the secondary cooling system.

32. The refrigeration system of claim 31 wherein the relief valve is located proximate an outlet of the refrigeration device and the discharge of the coolant is directed to a coolant return line from the refrigeration device.

33. The refrigeration system of claim 18 wherein the separator is oriented in a substantially horizontal configuration.

34. The refrigeration system of claim 18 wherein the third cooling system comprises one or more components of the primary cooling system.

35. The refrigeration system of claim 18 wherein the third cooling system comprises at least a portion of the primary cooling system and a generator.

36. A refrigeration system, comprising:

a primary cooling system configured to provide a first source of cooling to a coolant;

a secondary cooling system configured to circulate the coolant to at least one refrigeration device and to be cooled by the first source of cooling when the primary cooling system is operational; and at least one over-pressure protection device configured to maintain a pressure of the coolant below a predetermined pressure when the primary cooling system is not operational;

so that the pressure of the coolant does not exceed a predetermined pressure.

37. The refrigeration system of claim 36 wherein the coolant comprises carbon dioxide.

38. The refrigeration system of claim 36 wherein the primary cooling system comprises a first heat exchanger device configured to condense at least a portion of the coolant.

39. The refrigeration system of claim 38 wherein the secondary cooling system comprises a separator device configured to receive the coolant from the refrigeration device and direct a vapor portion of the coolant to the first heat exchanger and direct a liquid portion of the coolant to the refrigeration device.

40. The refrigeration system of claim 39 wherein the separator device is configured in a substantially horizontal orientation to increase a pressure of the coolant at the refrigeration device.

41. The refrigeration system of claim 39 wherein the separator device and the first heat exchanger are integrated as a unit.

42. The refrigeration system of claim 41 wherein the first heat exchanger is at least one tube-coil disposed within the separator.

43. The refrigeration system of claim 41 wherein the first heat exchanger is at least one plate type heat exchanger.

44. The refrigeration system of claim 41 wherein the first heat exchanger is a plurality of tube-coils and comprises a distributor configured to interface between a coolant supply line and the plurality of tube-coils.

45. The refrigeration system of claim 36 further comprising a standby cooling system configured to provide a second source of cooling to the coolant when the primary cooling system is not operational.

46. The refrigeration system of claim 45 wherein the standby cooling system comprises a power source configured to operate the standby cooling system independent of the primary cooling system.

47. The refrigeration system of claim 45 wherein the standby cooling system comprises a second heat exchanger.

48. The refrigeration system of claim 47 wherein the separator device and the second heat exchanger are combined as an assembled unit.

49. The refrigeration system of claim 48 wherein the second heat exchanger is disposed within an upper portion of the separator device.

50. The refrigeration system of claim 39 wherein the separator device and the first heat exchanger and the second heat exchanger are configured as an assembly.

51. The refrigeration system of claim 36 wherein the standby cooling system comprises at least one component of the primary cooling system.

52. The refrigeration system of claim 51 wherein the standby cooling system and the primary cooling system are configured to interface with a common heat exchanger.

53. The refrigeration system of claim 36 wherein the secondary cooling system comprises a coolant flow device configured for variable speed operation.

54. The refrigeration system of claim 53 wherein the coolant flow device is a pump.

55. The refrigeration system of claim 53 wherein the variable speed operation is configured for control in response to a signal representative of a temperature of the coolant.

56. The refrigeration system of claim 36 wherein the over-pressure protection device is a relief valve configured to direct a discharge of coolant to another location within the secondary cooling system.

57. The refrigeration system of claim 36 wherein the refrigeration device is at least one of a refrigerator, a freezer, a cold storage room, a walk-in cooler, a reach-in cooler, an open display case, and a closed display case.

58. The refrigeration system of claim 36 further comprising a first coolant line configured to supply the coolant to the refrigeration device and a second coolant line configured to return the coolant from the refrigeration device, wherein the first coolant line is routed at least partially within the second coolant line.

* * * * *